US008079345B2

(12) United States Patent
Okamoto

(10) Patent No.: US 8,079,345 B2
(45) Date of Patent: Dec. 20, 2011

(54) HIGH PRESSURE FUEL SUPPLY CONTROL SYSTEM FOR INTERNAL COMBUSTION ENGINE

(75) Inventor: Takashi Okamoto, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 356 days.

(21) Appl. No.: 12/437,132

(22) Filed: May 7, 2009

(65) Prior Publication Data

US 2009/0308351 A1 Dec. 17, 2009

(30) Foreign Application Priority Data

Jun. 16, 2008 (JP) ..... 2008-156095

(51) Int. Cl.
*F02M 37/04* (2006.01)
*F02M 37/06* (2006.01)

(52) U.S. Cl. ..... 123/506; 123/456

(58) Field of Classification Search ..... 123/456, 123/506, 508, 500–504, 495, 499; 417/213, 417/307

See application file for complete search history.

(56) References Cited

U.S. PATENT DOCUMENTS

| | | | | |
|---|---|---|---|---|
| 6,725,837 | B2 * | 4/2004 | Hiraku et al. | 123/436 |
| 2002/0033167 | A1 * | 3/2002 | Hiraku et al. | 123/456 |
| 2004/0069278 | A1 * | 4/2004 | Okamoto et al. | 123/458 |
| 2006/0118089 | A1 * | 6/2006 | Tokuo et al. | 123/458 |

FOREIGN PATENT DOCUMENTS

| | | | |
|---|---|---|---|
| JP | 2007-23930 | A | 2/2007 |
| JP | 2007-327409 | A | 12/2007 |

* cited by examiner

*Primary Examiner* — Mahmoud Gimie
(74) *Attorney, Agent, or Firm* — Crowell & Moring LLP

(57) ABSTRACT

A high pressure fuel supply control system for an internal combustion engine includes fuel injectors connected to a common rail, and a high pressure fuel pump for pressure-feeding to the common rail fuel that is supplied from a low-pressure fuel pump. The high pressure fuel pump includes a pressurized chamber, a plunger for pressurizing the fuel in the pressurized chamber, a fuel passage valve provided in the pressurized chamber, and an actuator for operating the fuel passage valve. A drive signal calculation unit calculates a drive signal for driving the actuator to control the discharge quantity of the high pressure fuel pump and the pressure in the common rail. The drive signal calculation unit maintains the discharge quantity of the high pressure fuel pump equal to or larger than a prescribed value.

18 Claims, 23 Drawing Sheets

HIGH PRESSURE FUEL SUPPLY CONTROL SYSTEM FOR INTERNAL COMBUSTION ENGINE

BACKGROUND OF THE INVENTION

1. Field of the Invention

The present invention relates to an internal combustion engine mounted, for example, on an automobile and more particularly to a control system for a direct injection internal combustion engine.

2. Description of the Related Art

Today, from a viewpoint of environmental protection, it is required to reduce such substances as carbon monoxide (CO), hydrocarbon (HC), and nitrogen oxide (NOx) contained in the gas emitted by automobiles. Direct injection engines have been developed to reduce such substances contained in emission gas. In a direct injection engine, fuel is injected from each injector directly into the combustion chamber of each engine cylinder, so that diameters of fuel particles emitted form the injector are reduced to promote fuel combustion and thereby reduce emission gas substances and increase the engine output power.

To reduce the diameters of fuel particles emitted from an injector, it is necessary to pressurize the fuel. Hence, various techniques to realize a high pressure fuel supply system have been proposed.

According to the technique described in JP-A No. 2007-23930, for example, a pressure accumulation type fuel injection control system which is provided with a pressure accumulating container for accumulating pressurized fuel to achieve stable fuel combustion and engine performance, injectors for injecting the high pressure fuel in the pressure accumulating container into the cylinders of the engine, and a fuel supply pump for pressurizing the sucked-in fuel and feeding the pressurized fuel to the pressure accumulating container and in which discharging of the fuel from the fuel supply pump to the pressure accumulating container is adjusted to achieve a target common rail pressure comprises: a pressure pattern estimation unit for estimating a fuel pressure transition in the pressure accumulating chamber during an injection period determined based on a requested injection quantity and a target common rail pressure; a surplus pressure range calculation unit for calculating, with the target common rail pressure determined based on pressure pattern data generated by the pressure pattern estimation unit, a pressure range where the pressure pattern data during the injection period exceeds the target common rail pressure; and a pressure reduction valve for controlledly releasing the common rail pressure to a low pressure side so as to remove the surplus pressure range calculated by the surplus pressure range calculation unit.

According to the technique described in JP-A No. 2007-327409, a fuel supply system for an internal combustion engine is provided with: a casing for reducing noise generated when fuel is pressure-transferred, the casing having an internal pressure chamber, a fuel inlet and a fuel outlet; a metering valve for opening and closing the fuel inlet; a biasing member for biasing the metering valve in the direction for opening the fuel inlet; a solenoid for providing the metering valve with an attractive force in the direction for closing the fuel inlet; a plunger which can, by reciprocating interlocked with a crankshaft, suck fuel into the pressure chamber and pressurize and pressure-transfer the sucked-in fuel; and a solenoid control unit for controlling the solenoid according to the operating condition of the internal combustion engine, the solenoid control unit determining the magnitude of the attractive force with which the solenoid provides the metering valve according to the fluid force of the fuel applied to the metering valve.

SUMMARY OF THE INVENTION

Various techniques for realizing a high pressure fuel pump for a direct injection internal combustion engine in which the discharge quantity of the pump is controlled by operating a fuel passage valve (hereinafter referred to as a "suction valve") provided in a pressurized chamber of the pump have been proposed.

In the above high pressure fuel pump, the discharge quantity of the pump is controlled by controlling the timing of closing a suction valve during a compression stroke of the pump. In the pump, the sum of a drive force electrically generated by an actuator to operate the suction valve and a fluid force generated in a pressurized chamber of the pump is used to close the suction valve.

FIG. 18 shows a relationship, relative to the pump plunger displacement in a pressurized chamber, between the fluid force and the plunger speed. The fluid force is proportional to the plunger speed in the pressurized chamber. The plunger speed depends on the profile of the pump drive cam working on the plunger.

Where the plunger speed is low, the fluid force is small and varies relatively largely, so that the time required to close the suction valve in response to a pump drive signal varies between discharge strokes of the pump.

Such varieties in the suction valve closing time lead to varieties in the discharge quantity of the pump and enlarge the fuel pressure pulsation in the common rail. When the fuel pressure pulsation is severe, fuel combustion becomes less stable and the emission performance of the engine deteriorates.

Control systems, according to existing techniques, for a direct injection internal combustion engine provided with a pressure reducing valve and a high pressure fuel pump are designed with attention given to fluid force varieties in the high pressure pump, and without aiming at reducing shot-to-shot varieties in the discharge quantity of the pump.

The present invention has been made in view of the above problem, and it is an object of the invention to provide a fuel supply control system for an internal combustion engine in which a high pressure fuel pump is controlled to pressure-feed fuel while the fluid force therein is not small so as to reduce shot-to-shot discharge quantity varieties and thereby contribute toward stabilizing fuel system operation and improving the emission performance of the engine.

To achieve the above object, the present invention provides a fuel supply control system for an internal combustion engine, the control system controlling a fuel pump which takes fuel on a low pressure side into a pressurized chamber via a fuel passage valve opening and closing according to movement of an actuator, pressurizes the fuel using a plunger, and discharges the fuel into a common rail. In the control system, the fuel pump is controlled, by controlling the actuator, to keep the discharge quantity thereof larger than a first prescribed value.

The fuel pump control system for an internal combustion engine according to the present invention can contribute toward stabilizing fuel system operation and fuel combustion and improving the emission performance of the engine.

DETAILED DESCRIPTION OF THE PREFERRED EMBODIMENTS

Figure 1:
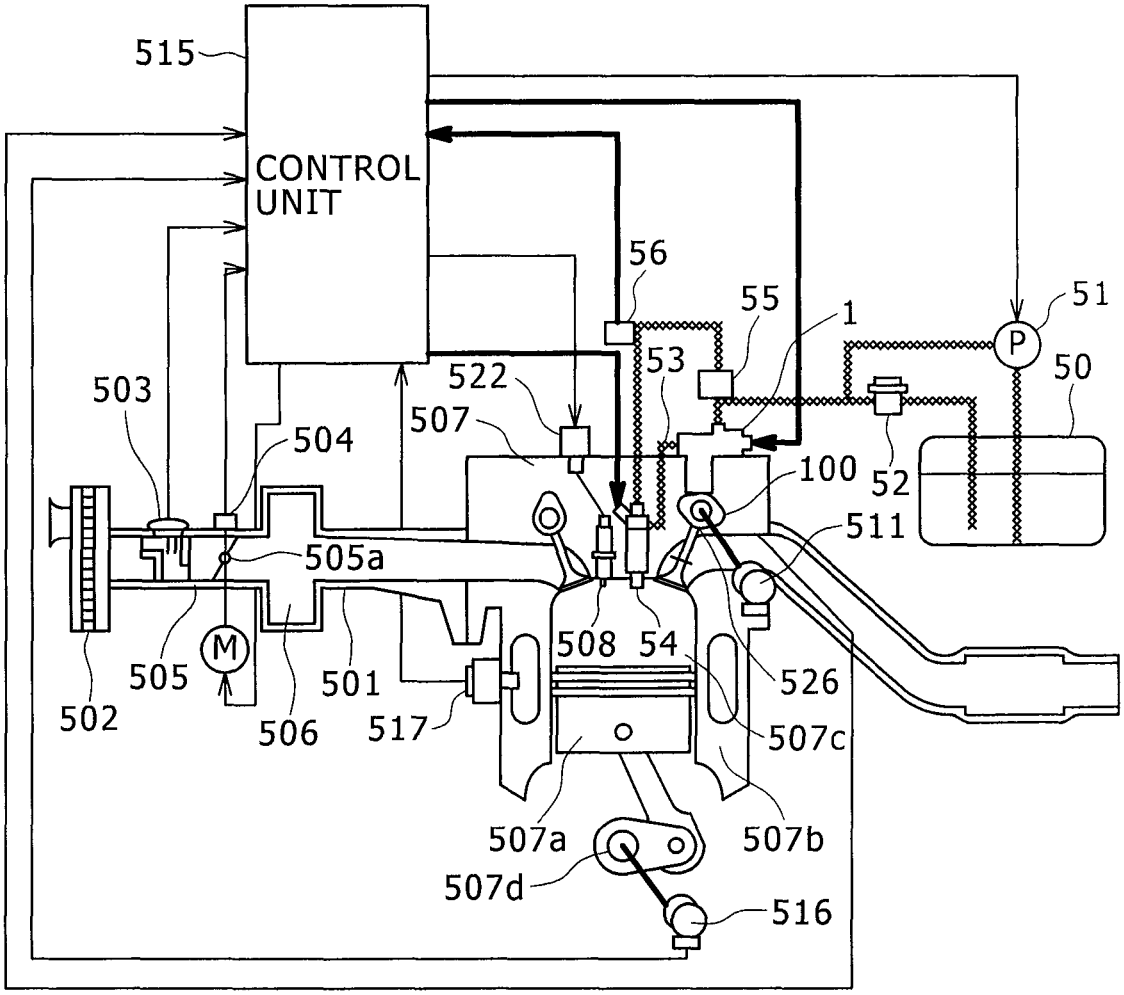
FIG. 1 is a diagram showing an overall configuration of an engine provided with a fuel supply control system for an internal combustion engine according to an embodiment of the present invention.

According to a preferred embodiment of the present invention, a fuel supply control system for an internal combustion engine basically includes fuel injectors provided for a common rail and a high pressure fuel pump for pressure-feeding the fuel sent out from a low-pressure fuel pump to the common rail. In the control system, the high pressure fuel pump includes a pressurized chamber, a plunger for pressurizing the fuel in the pressurized chamber, a fuel passage valve provided in the pressurized chamber, and an actuator for operating the fuel passage valve. The control system has a drive signal calculation unit which calculates a drive signal for driving the actuator so as to control the discharge quantity of the high pressure fuel pump and the pressure in the common rail. The drive signal calculation unit has a means of keeping the discharge quantity of the high pressure fuel pump equal to or larger than a prescribed value.

Furthermore, in the control system, when a pressure decrease in the common rail is requested, it is prohibited to make the discharge quantity of the high pressure fuel pump equal to or larger than a prescribed value.

Also, in the control system, the prescribed discharge quantity of the high pressure fuel pump is set such that the fluid force applied to the fuel passage valve in the pressurized chamber in a closing direction thereof is equal to or larger than a prescribed value.

Also, in the control system, the prescribed discharge quantity of the high pressure fuel pump is determined according to the engine speed.

Also, in the control system, the prescribed discharge quantity of the high pressure fuel pump does not exceed one half of a full discharge quantity of the high pressure fuel pump.

Also, in the control system, a device for returning fuel in the high pressure fuel pump or the common rail to a low pressure side is provided.

Also, in the control system, the device for returning fuel to the low pressure side is an electric pressure control valve which is opened by an electric drive signal.

Also, in the control system, the electric pressure control valve is open during a discharge stroke of the high pressure fuel pump.

Also, in the control system, the minimum flow amount of the electric pressure control valve does not exceed the prescribed discharge quantity of the high pressure fuel pump.

Also, in the control system, when a pressure increase in the common rail is requested, the electric pressure control valve is closed.

Also, in the control system, when a discharge quantity equal to or larger than the prescribed discharge quantity of the high pressure fuel pump is requested, the electric pressure control valve is closed.

The fuel supply control system for an internal combustion engine of the present invention configured as described above can pressure-feed the fuel in a high pressure fuel pump by making effective use of a period in which the fluid force in the high pressure fuel pump is large. This makes it possible to reduce shot-to-shot varieties in the quantity of fuel discharged by the pump and fuel pressure pulsation, thereby contributing toward stabilizing fuel system operation and fuel combustion and improving the emission performance of the engine.

A high pressure fuel supply control system for an internal combustion engine according to an embodiment of the present invention will be described below with reference to drawings. FIG. 1 shows an overall configuration of the control system of a direct injection engine 507 according to the present embodiment. The direct injection engine 507 is a four-cylinder engine. The air to be introduced into each cylinder 507*b* of the engine 507 is taken in through an inlet of an air cleaner 502. The air then advances passing an air flow sensor 503 and a throttle body 505 in which an electric throttle valve 505*a* for controlling the air flow rate is accommodated and enters a collector 506. The air taken in the collector 506 is distributed to intake pipes 501 respectively connected to the corresponding cylinders 507*b* of the engine 507 to be then introduced into the corresponding combustion chambers 507*c* each formed by such parts as a corresponding piston 507*a* and the corresponding cylinder 507*b*. The air flow sensor 503 outputs a signal indicating the flow rate of the taken-in air to an engine control unit 515 including a high pressure fuel pump control system of the present embodiment. The throttle body 505 is attached with a throttle sensor 504 for detecting the degree of opening of an electric throttle valve 505*a*. The throttle sensor 504 also outputs a signal indicating the detected throttle valve opening to the control unit 515.

The fuel, for example, gasoline is supplied from a fuel tank 50 using a low-pressure fuel pump 51. After the fuel is pressurized first by the low-pressure fuel pump 51, a fuel pressure regulator 52 regulates the fuel pressure to a constant pressure (for example, 3 kg/cm$^2$). Subsequently, the fuel is subjected to the secondary pressurization at a high pressure fuel pump 1 being described later to be pressurized to a higher pressure (for example, 50 kg/cm$^2$). The fuel is then sent, via a common rail 53, to an injector 54 provided for each cylinder 507*b* and injected into the combustion chamber 507*c*. The fuel injected into the combustion chamber 507*c* is ignited by an ignition plug 508 using an ignition signal of a high voltage generated at an ignition coil 522.

A crank angle sensor (hereinafter referred to as the "position sensor") 516 attached to a crankshaft 507*d* of the engine 507 outputs a signal indicating the rotational position of the crankshaft 507*d* to the control unit 515. A crank angle sensor (hereinafter referred to as the "phase sensor") 511 attached to the cam shaft (not shown) including a mechanism which can vary the timing of opening/closing of an exhaust valve 526 outputs an angle signal indicating the rotational position of the cam shaft and also an angle signal indicating the rotational position of a pump drive cam 100 of the high pressure fuel pump 1 rotating together with the cam shaft of the exhaust valve 526 to the control unit 515.

Figure 2:
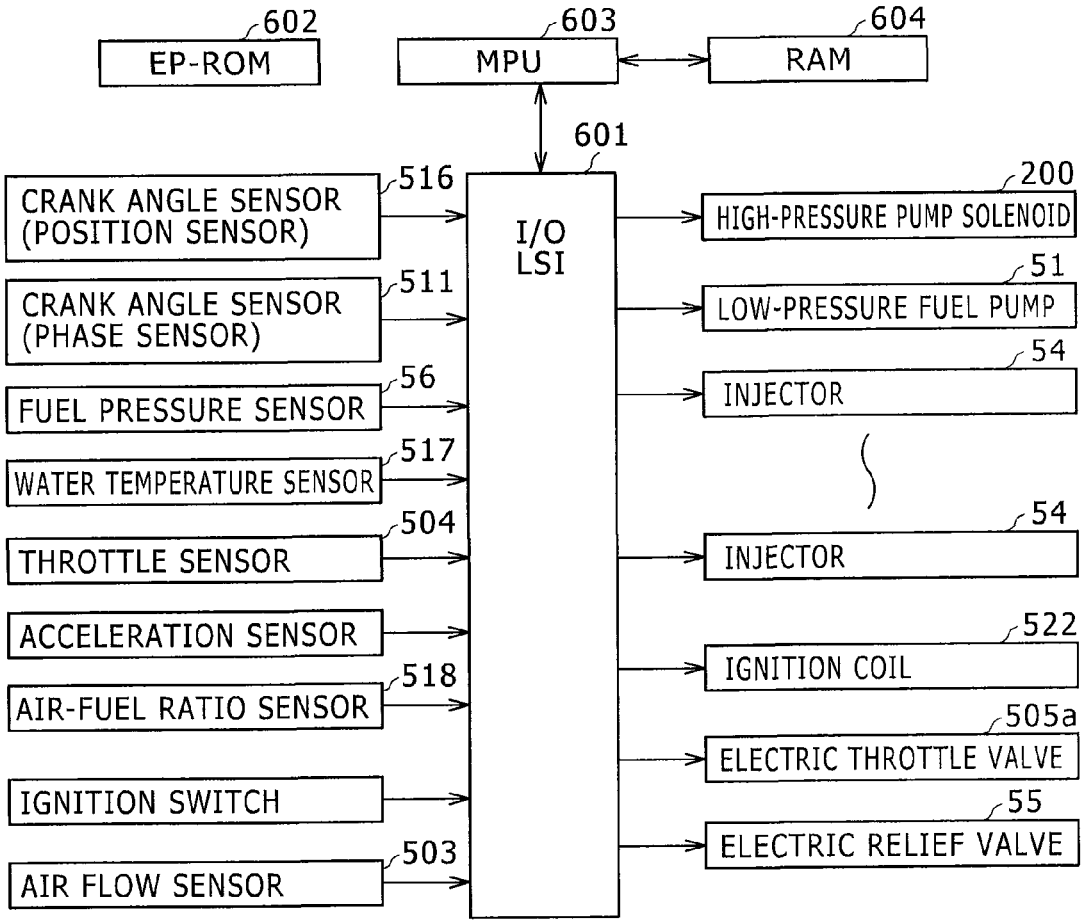
FIG. 2 is a diagram showing an internal configuration of the engine control unit shown in FIG. 1.

An essential part of the control unit 515 includes, as shown in FIG. 2, an MPU 603, an EP-ROM 602, a RAM 604, and an I/O LSI including an A/D converter. The control unit 515 receives signals from various sensors, for example, the position sensor 516, the phase sensor 511, a water temperature sensor 517, and a fuel pressure sensor 56. A predetermined calculating process is performed and resultant calculated various control signals are output. The predetermined control signals are supplied to a high pressure pump solenoid 200 serving as an actuator, the injectors 54, and the ignition coils 522, to control, for example, the fuel pressure in the common rail, fuel injection quantity, and ignition time.

Figure 3:
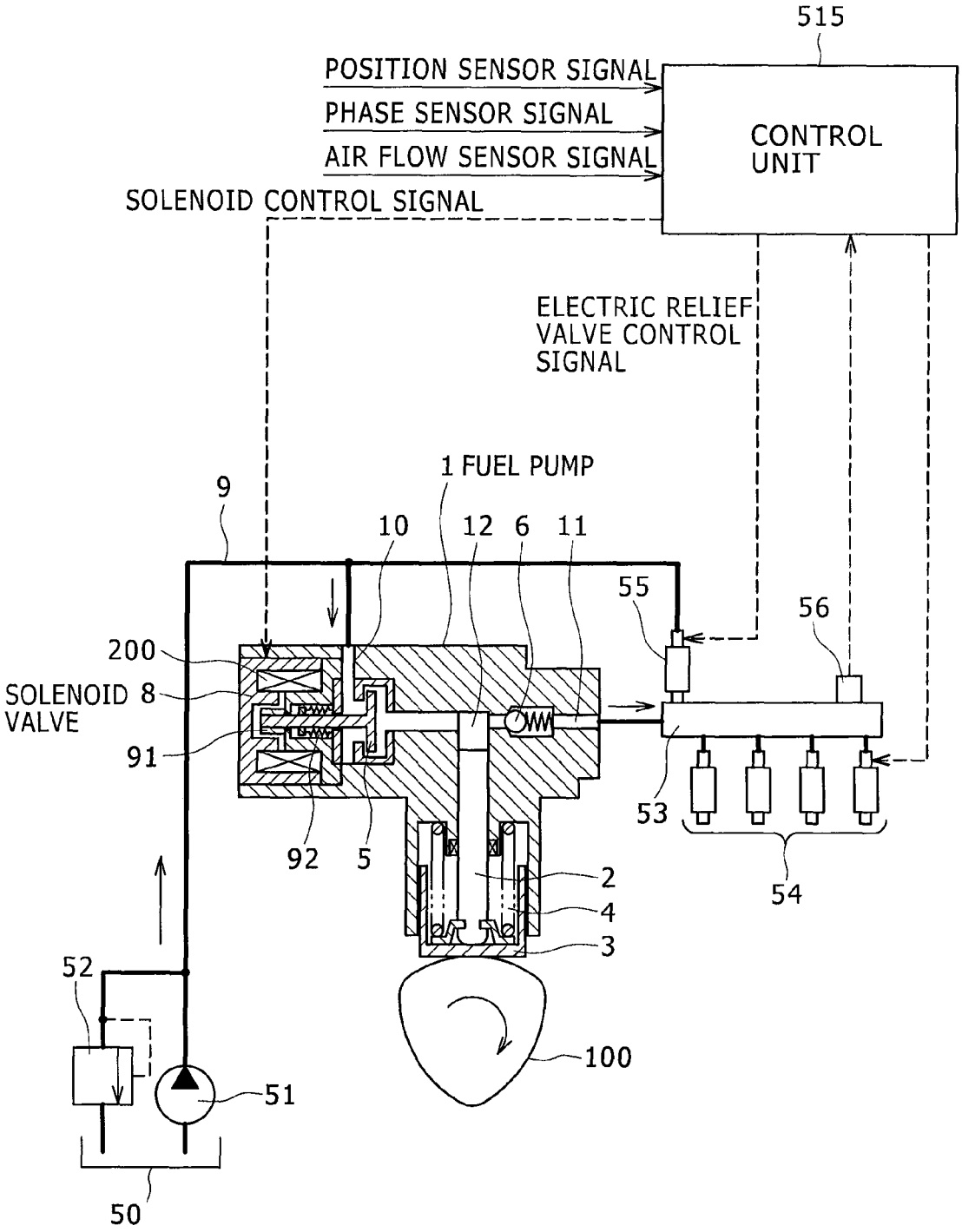
FIG. 3 is a diagram showing an overall configuration of a fuel system including the high pressure fuel pump shown in FIG. 1.
Figure 4:
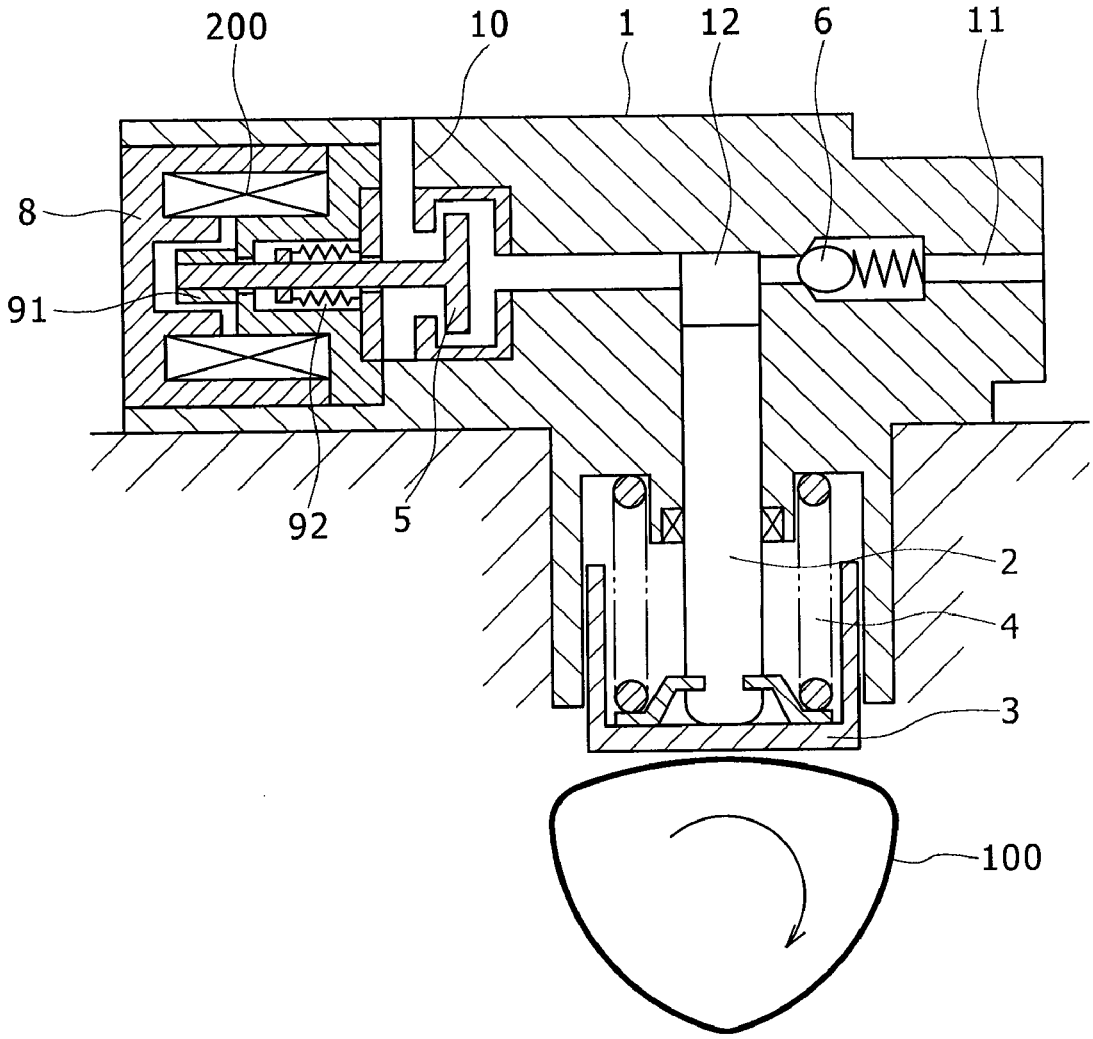
FIG. 4 is a diagram showing a longitudinal section of the high pressure fuel pump shown in FIG. 3.

FIG. 3 shows an overall configuration of a fuel system including the high pressure fuel pump 1. FIG. 4 shows a longitudinal section of the high pressure fuel pump 1.

The high pressure fuel pump 1 pressurizes the fuel supplied from the fuel tank 50 and pressure-feeds the high pressure fuel to the common rail 53. The high pressure fuel pump 1 includes a fuel suction passage 10, a discharge passage 11, and a pressurized chamber 12. A plunger 2 is slidably held as a pressurizing member in the pressurized chamber 12. The discharge passage 11 is provided with a discharge valve 6 for preventing the downstream high pressure fuel from flowing back into the pressurized chamber 12. The intake passage 10 is provided with a solenoid valve 8 for controlling the fuel intake. The solenoid valve 8 is of a normally-closed type. It closes when de-energized and opens when energized.

The low-pressure fuel pump 51 sends the fuel supplied from the tank 50 and regulated to a constant pressure by the pressure regulator 52 to an inlet of the high pressure fuel pump 1. The fuel is then pressurized at the high pressure fuel pump 1 and pressure-fed through a fuel discharge outlet to the common rail 53. The common rail 53 is fitted with the injectors 54, the fuel pressure sensor 56, and an electric pressure control valve (hereinafter referred to as the "electric relief valve) 55. The electric relief valve 55 opens when the fuel pressure in the common rail 53 exceeds a prescribed value or when an electric drive signal is received so as to control the fuel pressure and prevent the high pressure piping system from being damaged.

Figure 20:
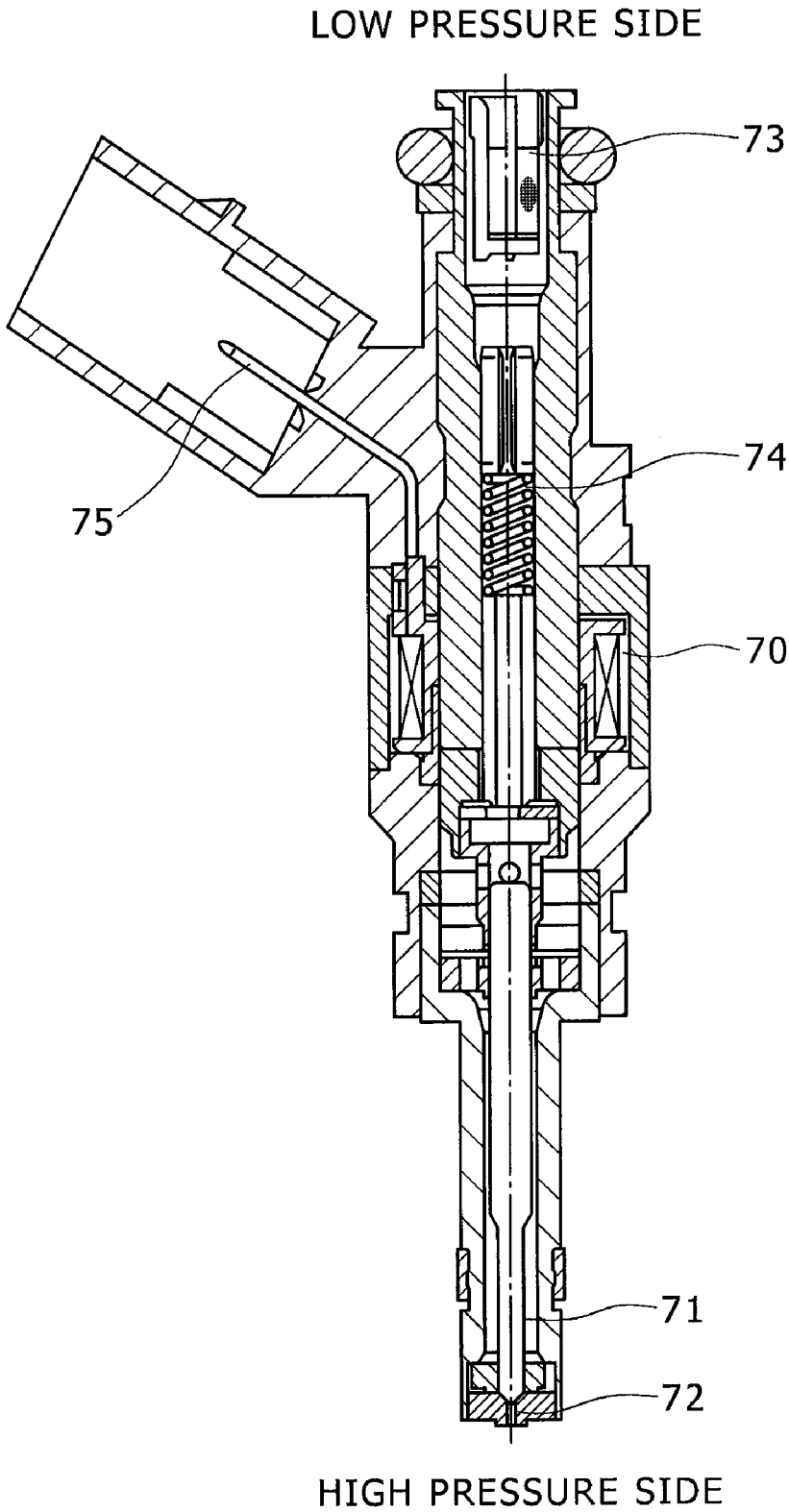
FIG. 20 is a diagram showing a longitudinal section of an electric relief valve.

FIG. 20 shows a longitudinal section of the electric relief valve 55. The electric relief valve 55 is provided with a magnet coil 70 which is energized/de-energized by an electric signal received from the control unit 515 via a pin terminal 75 thereof. When the magnet coil 70 is energized, the relief valve 71 is moved upward to open a fuel passage 72 connected to the common rail 53 thereby causing the fuel in the common rail 53 to be released through a fuel outlet 73. When the power from the control unit 515 is shut off, the magnet coil 70 is de-energized, and a spring 74 biased to close the relief valve 71 closes the relief valve 71. When the fuel pressure in the common rail 53 subsequently increases and exceeds the biasing force of the spring 74, the relief valve 71 is moved upward to open the fuel passage 72 thereby causing the fuel in the common rail 53 to be released through the fuel outlet 73.

The number of the injectors 54 corresponds to the number of the cylinders 507*b* included in the engine 507. Each of the injectors 54 injects fuel into the corresponding cylinder 507*b* responding to a drive current from the control unit 515. The fuel pressure sensor 56 collects pressure data and outputs the pressure data to the control unit 515. The control unit 515 calculates, for example, an appropriate fuel injection quantity and fuel pressure based on the information on operating conditions of the engine (for example, information on crank rotation angle, throttle opening, engine speed, and fuel pressure) obtained from various sensors, and controls, for example, the pump 1 and the injectors 54.

A pump drive cam 100 rotating together with the cam shaft of the exhaust valve 526 included in the engine 507 causes, via a lifter 3 pressed thereagainst, the plunger 2 to reciprocate thereby allowing the plunger 2 to vary the inner volume of the pressurized chamber 12. When the plunger 2 descends causing the inner volume of the pressurized chamber 12 to increase, the solenoid valve 8 opens causing the fuel to flow in the pressurized chamber 12 through the fuel intake passage 10. The descending stroke of the plunger 2 will be hereinafter referred to as a "suction stroke." When the plunger 2 ascends causing the inner volume of the pressurized chamber 12 to decrease, the solenoid valve 8 closes causing the fuel in the pressurized chamber 12 to be pressurized and pressure-fed into the common rail 53 via the discharge valve 6. The ascending stroke of the plunger 2 will be hereinafter referred to as a "compression stroke."

Figure 5:
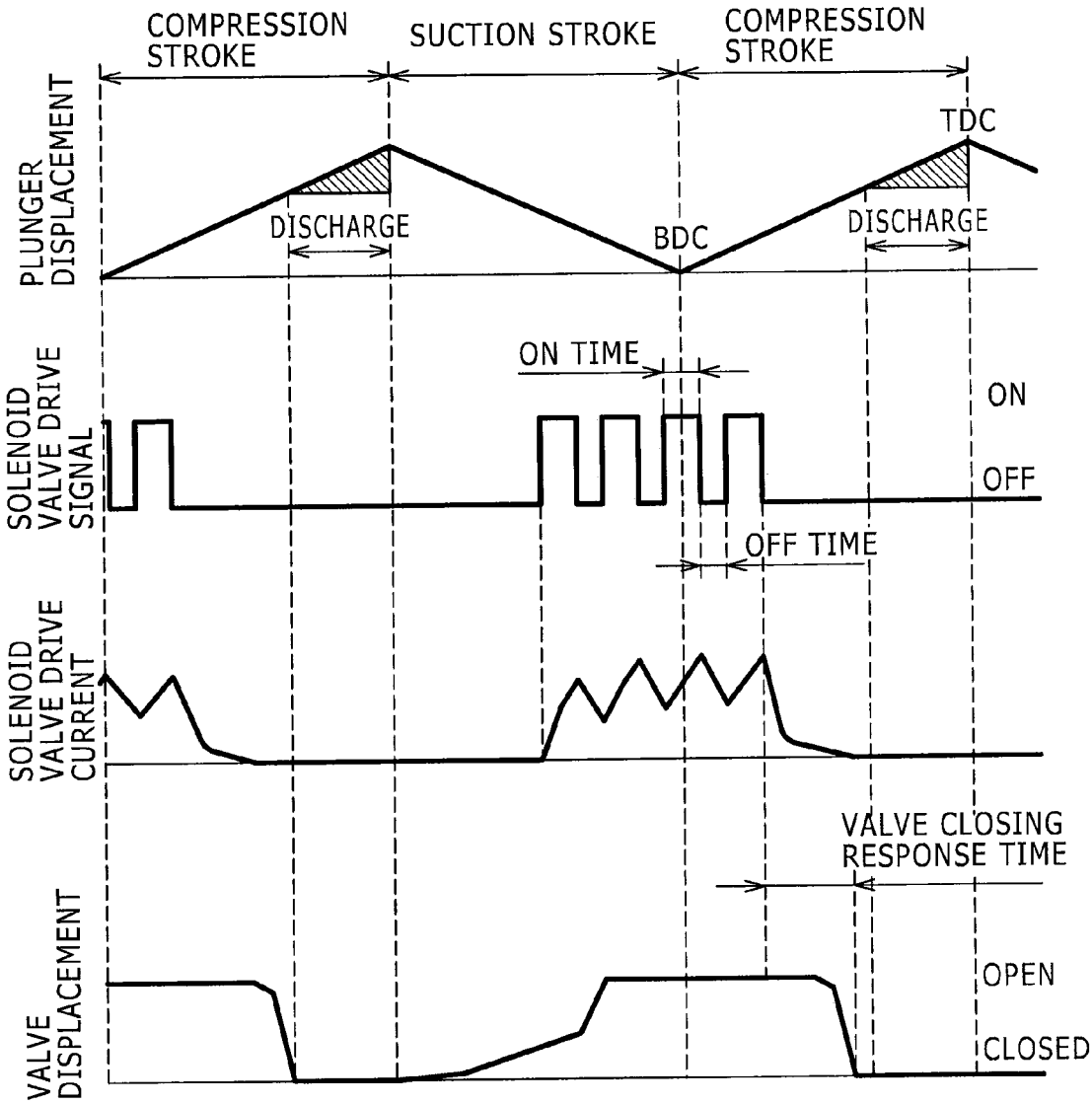
FIG. 5 is an operation timing chart of the high pressure fuel pump shown in FIG. 3.
Figure 6:
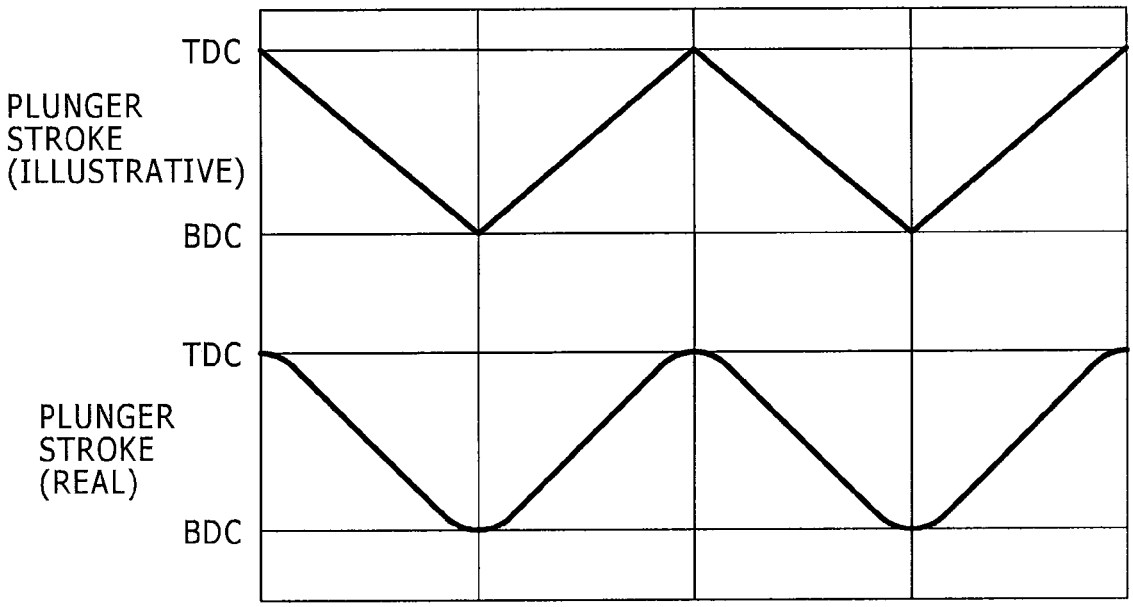
FIG. 6 is an explanatory diagram supplementary to the operation timing chart shown in FIG. 5.

FIG. 5 is a timing chart of operation of the high pressure fuel pump 1. Even though the actual strokes of the plunger 2 driven by the pump drive cam 100 are represented by curves as shown as "actual" in FIG. 6, they will be regarded, in the following description, as being represented curvelessly as shown as "illustrative" in FIG. 6. This is just to make the top dead center (T.D.C.) and bottom dead center (B.D.C.) of the plunger 2 easily recognizable.

When, during a compression stroke, the solenoid valve 8 closes, the fuel taken in the pressurized chamber 12 is pressurized and discharged into the common rail 53. If, during a compression stroke, the solenoid valve 8 is open, the fuel is pushed back into the intake passage 10, so that the fuel in the pressurized chamber 12 is not discharged into the common rail 53. Thus, discharging of the fuel by the pump 1 is controlled by the opening/closing of the solenoid valve 8 that is controlled by the control unit 515.

The solenoid valve 8 has such components as a valve 5, a spring 92 biasing the valve 5 in the opening direction, the solenoid 200, and an anchor 91. When an electric current flows through the solenoid 200, an electromagnetic force is generated in the anchor 91. As a result, the anchor 91 is pulled rightward as seen in FIG. 4 causing the valve 5 formed integrally with the anchor 91 to open. When no electric current is flowing through the solenoid 200, the valve 5 is closed by the spring 92 biasing the valve 5 in the closing direction. The solenoid valve 8 is closed when no electric current is flowing through it, so that it is referred to as a normally closed solenoid valve.

During, a suction stroke, the pressure in the pressurized chamber 12 becomes lower than the pressure in the intake passage 10, and the pressure difference between the two causes the valve 5 to open allowing the fuel to be taken into the pressurized chamber 12. At this time, even though the spring 92 biases the valve 5 in the closing direction, the valve 5 opens with the valve opening force generated by the pressure difference exceeding the valve biasing force of the spring 92. If, at this time, a drive current is flowing through the solenoid 200, the magnetic attractive force generated by the solenoid 200 is applied in the direction for opening the valve 5 making it easier for the valve 5 to open.

During a compression stroke, the pressure in the pressurized chamber 12 becomes higher than the pressure in the intake passage 10, so that no pressure difference to cause the valve 5 to open is generated. When, in this state, no drive current is flowing through the solenoid 200, the valve 5 is closed by the force of the spring 92 biasing the valve 5 in the closing direction. If a drive current is flowing through the solenoid 200 generating an adequate magnetic attractive force, the valve 5 is biased in the opening direction.

Therefore, causing a drive current to start flowing through the solenoid 200 of the solenoid valve 8 during a suction stroke and keeping the drive current flowing through the subsequent compression stroke keeps the valve 5 open. During that time, the fuel in the pressurized chamber 12 flows back into the low-pressure passage 10 without being pressure-fed into the common rail 53. Stopping the drive current flowing through the solenoid 200 at a time during a compression stroke closes the valve 5 causing the fuel in the pressurized chamber 12 to be pressurized and discharged into the discharge passage 11. The volume of the fuel thus pressurized is larger when the drive current is stopped earlier and smaller when the drive current is stopped later. The control unit 515 can therefore control the discharge quantity of the pump 1 by controlling the timing of closing the valve 5.

Furthermore, determining, based on a signal from the fuel pressure sensor 56, an appropriate timing of turning off a pump energization signal and controlling the solenoid 200 makes it possible to vary the discharge quantity of the pump 1 and feedback-control the pressure in the common rail 53 to a target value. Namely, the discharge quantity of the pump 1 can be converted into the timing of turning off the pump energization signal.

Figure 7:
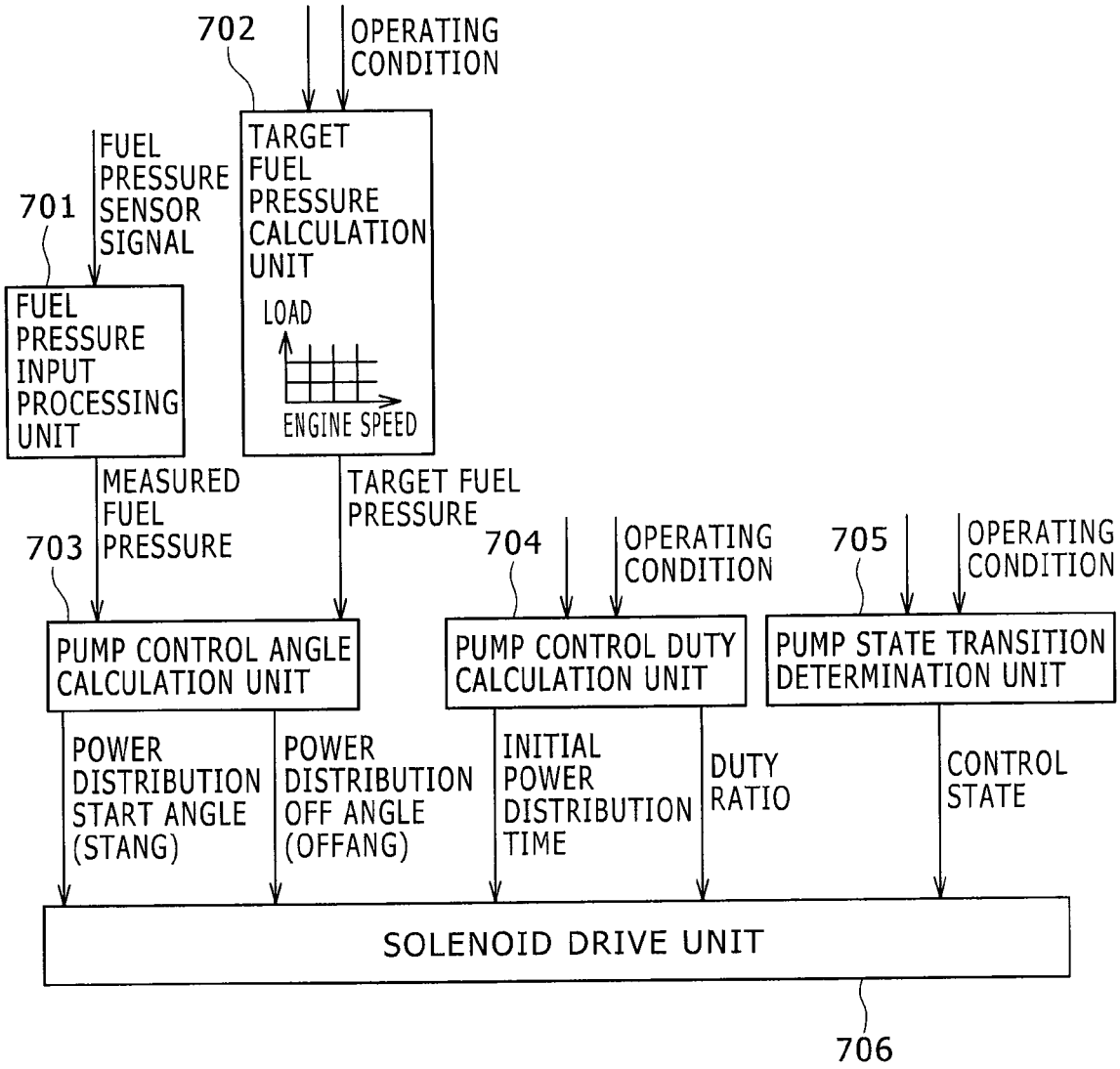
FIG. 7 is a control block diagram according to the present invention of the engine control unit shown in FIG. 1.

FIG. 7 is a control block diagram showing an aspect of controlling the high pressure fuel pump 1 performed by the MPU 603 included in the control unit 515 having the high pressure fuel pump control system. The high pressure fuel pump control system includes a fuel pressure input processing unit 701 which subjects a signal from the fuel pressure sensor 56 to a filtering process and outputs an actual fuel pressure value, a target fuel pressure calculation unit 702 which calculates, based on the engine speed and load, a target fuel pressure optimum for an operating point, a pump control angle calculation unit 703 which calculates a phase parameter for controlling the pump discharge quantity, a pump control duty calculation unit 704 which calculates a parameter of a duty signal used as a pump drive signal, a pump state transition determination unit 705 which determines a state of the direct injection engine 507 and shifts pump control mode, and a solenoid drive unit 706 which makes an electric current generated from the duty signal flow through the solenoid 200.

Figure 8:
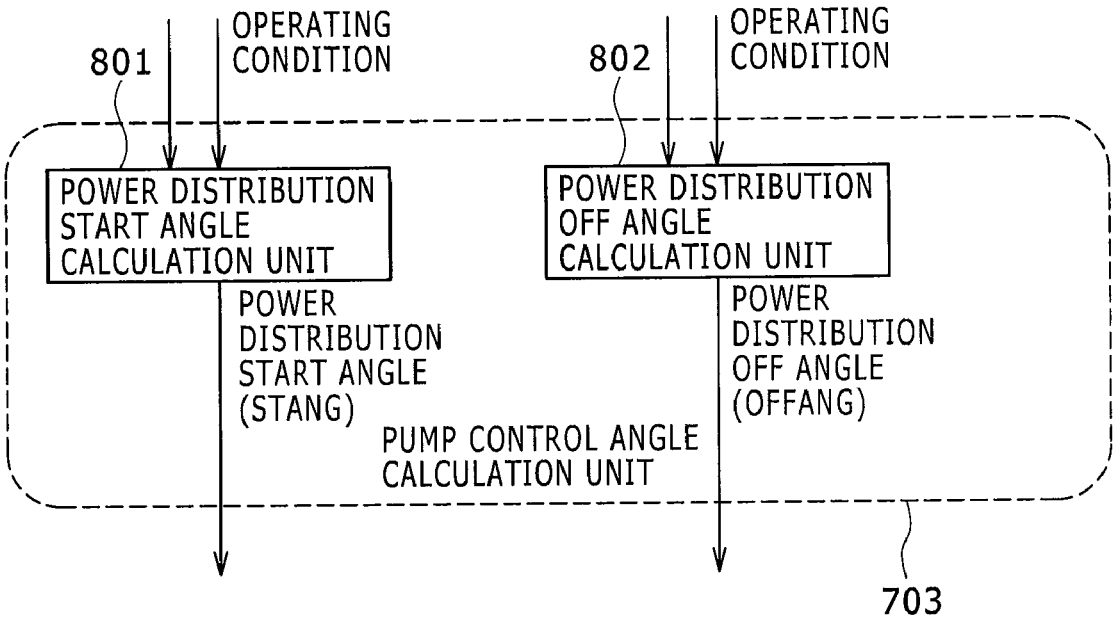
FIG. 8 is a control block diagram according to the present invention of the engine control unit shown in FIG. 1.

FIG. 8 shows an aspect of the pump control angle calculation unit 703. The pump control angle calculation unit 703 includes a power distribution start angle calculation unit 801 and a power distribution off angle calculation unit 802.

Figure 9:
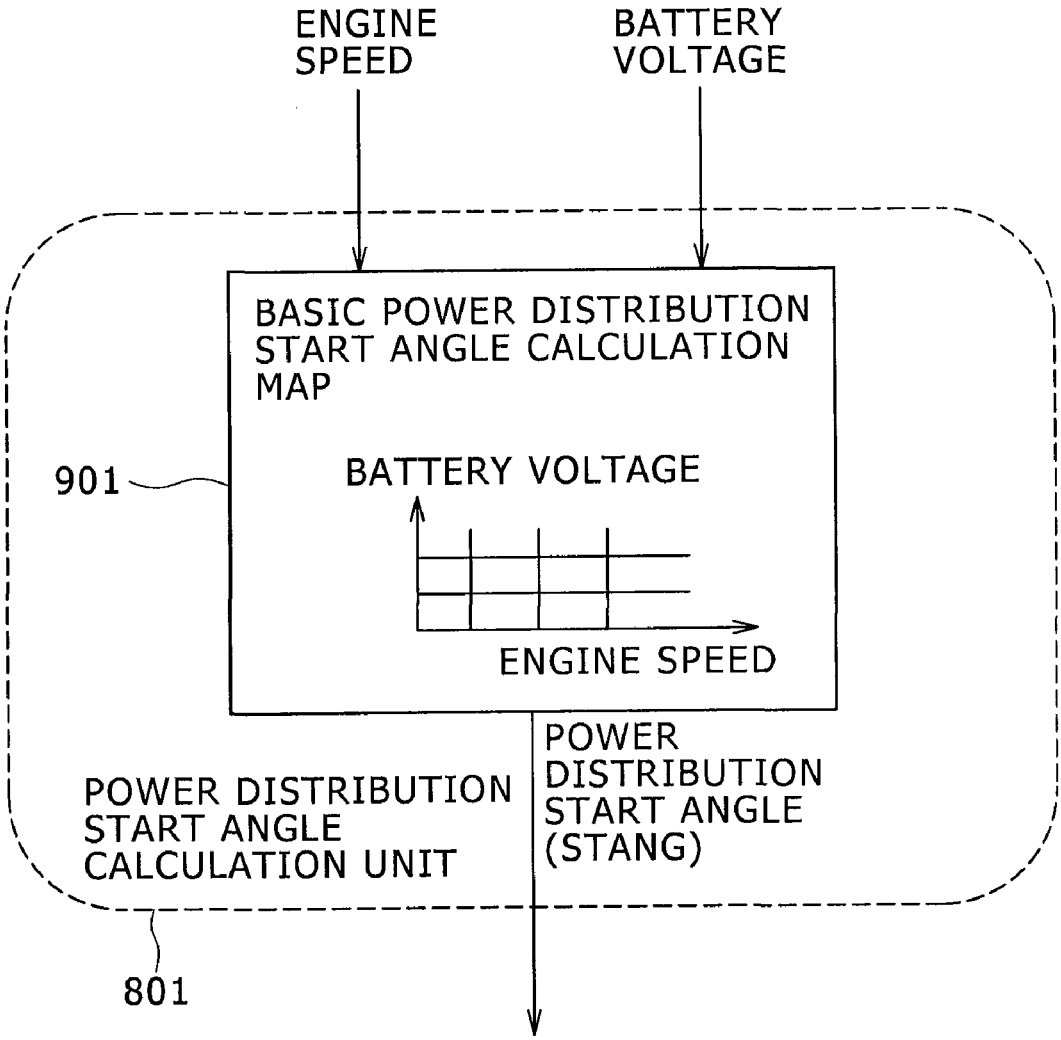
FIG. 9 is a control block diagram according to the present invention of the engine control unit shown in FIG. 1.

FIG. 9 shows an aspect of the power distribution start angle calculation unit 801. The power distribution start angle calculation unit 801 calculates a power distribution start angle STANG based on a map to which engine speed and battery voltage information is inputted.

Figure 10:
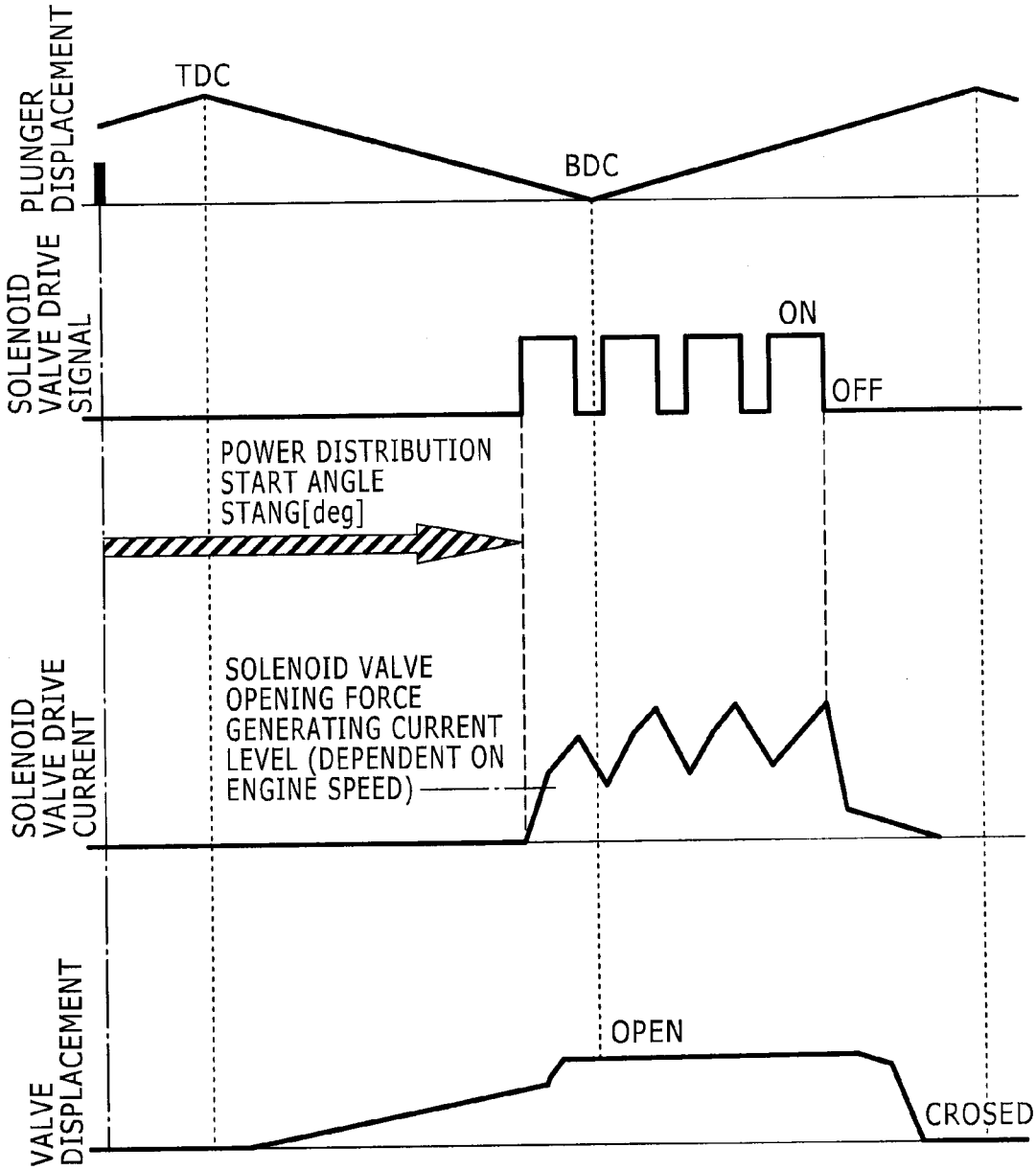
FIG. 10 is a diagram showing how a power distribution start angle is set for the high pressure fuel pump.

FIG. 10 shows how the power distribution start angle STANG is set. Since the pump 1 is a normally closed pump, unless a force which can open the solenoid valve 8 is applied before the B.D.C. of the pump plunger is reached, the solenoid valve is closed to cause a full discharge.

Therefore, if the power distribution start angle is not accurately controlled, unexpected fuel pressurization can result. Furthermore, if power distribution is started uniformly when the T.D.C. of the pump plunger is reached, the solenoid valve may be given more time than required to generate a required magnetic attractive force leading to increases in power consumption and heat generation.

The force that can open the solenoid valve 8 mentioned above refers to a force which grows larger in proportion to the engine speed and exceeds the fluid force exerted in the valve closing direction in the pump. Since the force generated in the solenoid 200 is proportional to the current flowing therethrough, at least a minimum required amount of electric current is required to be flowing through the solenoid 200 before the B.D.C of the pump plunger is reached. The time required before the electric current reaches the minimum required amount depends on the battery voltage used as a power supply for the solenoid, and the minimum required amount of electric current depends on the engine speed. Hence the basic power distribution start angle is calculated based on a map to which engine speed and battery voltage information is inputted.

Figure 11:
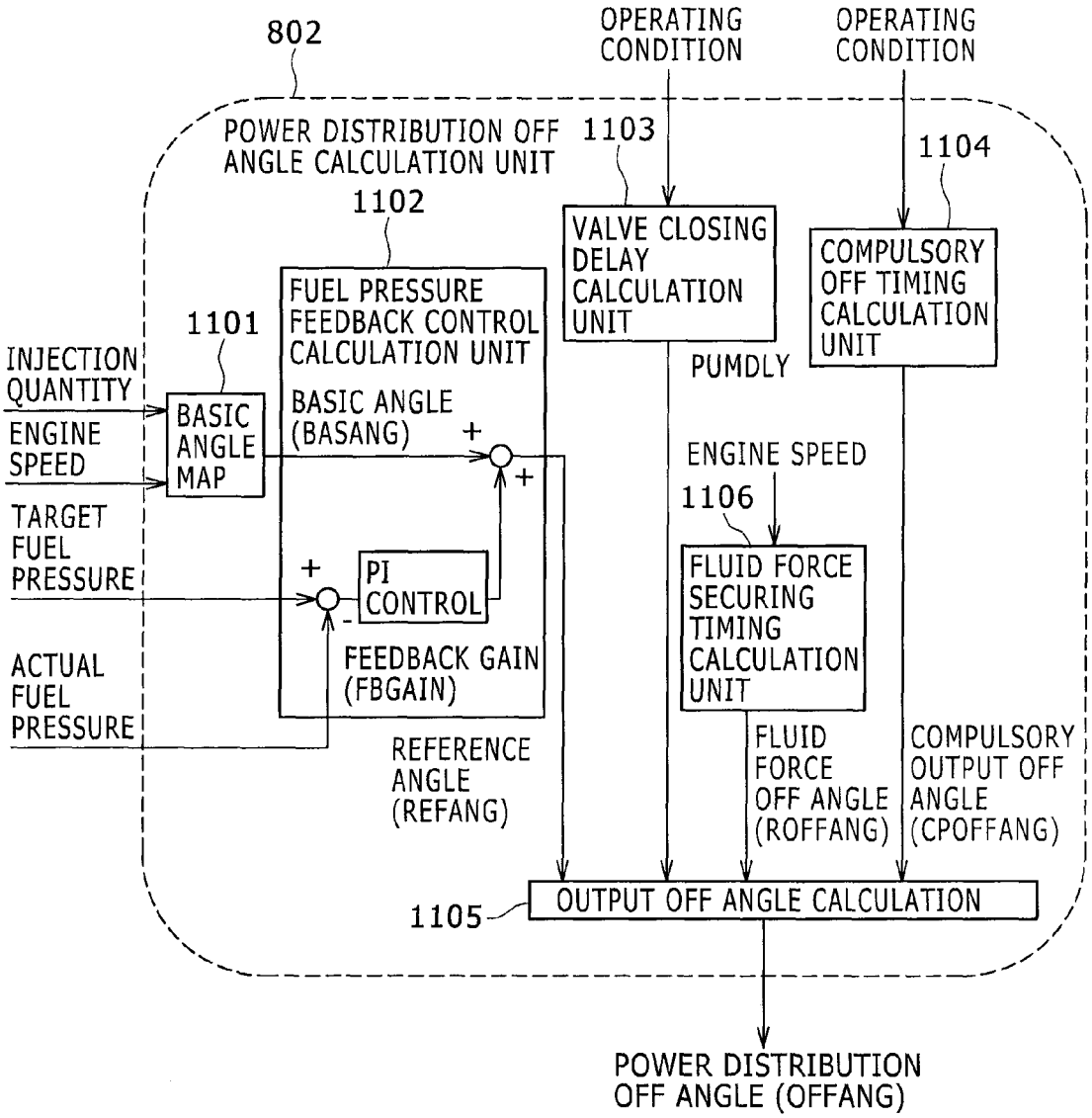
FIG. 11 is a control block diagram according to the present invention of the engine control unit shown in FIG. 1.

FIG. 11 shows an aspect of the power distribution off angle calculation unit 802. The discharge quantity of the pump 1 is controlled by changing the power distribution off angle. A basic angle BASANG is calculated based on a basic angle map 1101 to which fuel injection quantity and engine speed information is inputted. The BASANG represents a valve closing angle corresponding to a requested pump discharge quantity in a steady operating state.

Figure 12:
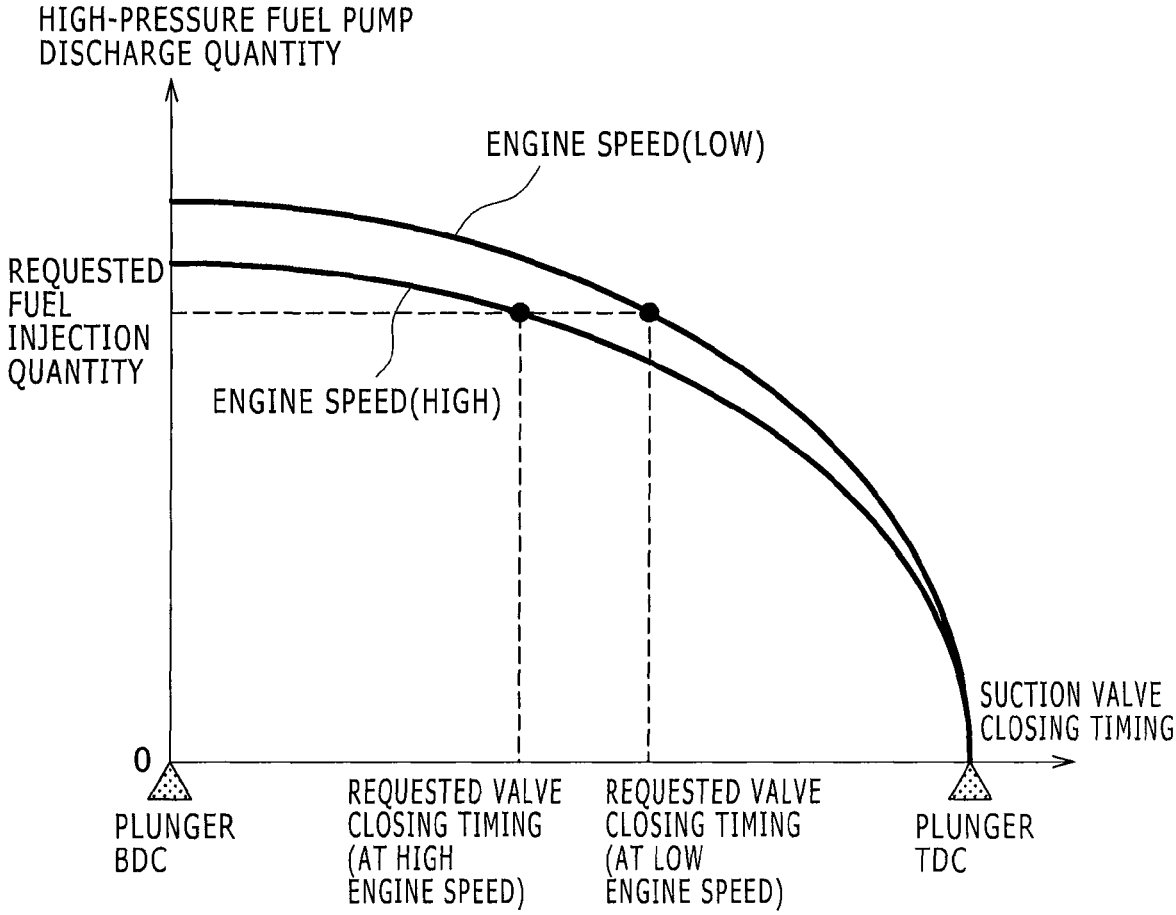
FIG. 12 shows a discharge quantity characteristic of the high pressure fuel pump shown in FIG. 3.

How the basic angle BASANG is set will be explained with reference to FIG. 12. The discharge quantity of the high pressure fuel pump relative to the valve closing timing is shown in FIG. 12. The discharge quantity of the pump is lower when the solenoid valve is closed with the plunger more toward the T.D.C. Since the discharge efficiency of the high pressure fuel pump varies with the engine speed, the discharge quantity of the pump also varies with the engine speed. Hence, the basic angle BASANG varies with the engine speed. The responsiveness in controlling the pump discharge quantity can be improved by calculating the basic angle BASANG based on a map to which information on the quantity of fuel injected by the injector and engine speed is inputted.

In a fuel pressure feedback control calculation section, a reference angle REFANG is calculated by adding a feedback amount calculated based on a target fuel pressure and an actual fuel pressure to the basic angle BASANG. The reference angle REFANG represents an angle, with respect to a standard REF, at which the solenoid valve 8 is to be closed.

A power distribution off angle OFFANG is calculated by subtracting a valve closing delay PUMDLY calculated based on a map, to which information on the reference angle REFANG and engine speed is inputted, from the REFANG.

Figure 19:
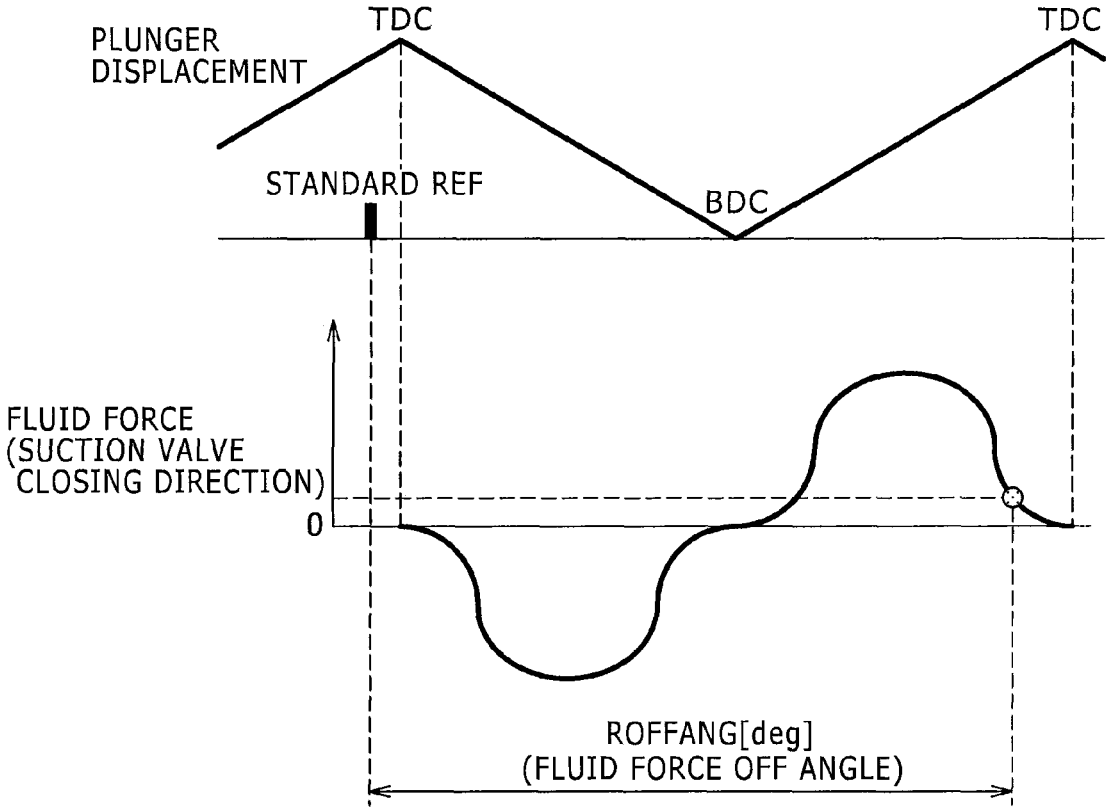
FIG. 19 is a diagram showing how a fluid force off angle is set for the high pressure fuel pump.

A fluid force off angle ROFFANG calculated by a fluid force securing timing calculation unit 1106 is set as an upper limit value of the power distribution off angle OFFANG. FIG. 19 shows how the ROFFANG is set. The ROFFANG represents a maximum angle, relative to the standard REF, which causes the fluid force exerted in the suction valve closing direction in the pressurized chamber to be equal to or larger than a prescribed value. The prescribed value is determined to be within an allowable variety range of the pump discharge quantity.

The fluid force in the pressurized chamber is larger when the engine speed is higher. In the fluid force securing timing calculation unit 1106, therefore, the ROFFANG is calculated using a table to which engine speed information is inputted. To improve the ROFFANG calculation accuracy, a parameter to affect the fluid force may be corrected.

The fluid force also reduces where the pump discharge quantity is high. In a high discharge quantity range, however, shot-to-shot fluid force varieties due to varieties in suction valve closing speed are relatively small, so that, with priority placed on securing a required pump discharge quantity, no lower limit value for securing a minimum required fluid force is set for the OFFANG.

A compulsory output off angle CPOFFANG is used when the fuel supply is cut off and operation with no discharge from the pump is requested and also when a fuel pressure decrease is requested. The power distribution off angle OFFANG is applied as the compulsory output off angle CPOFFANG. For the OFFANG used when the fuel supply is cut off or when a fuel pressure decrease is requested, the fluid force off angle ROFFANG is not applied as an upper limit value.

Figure 13:
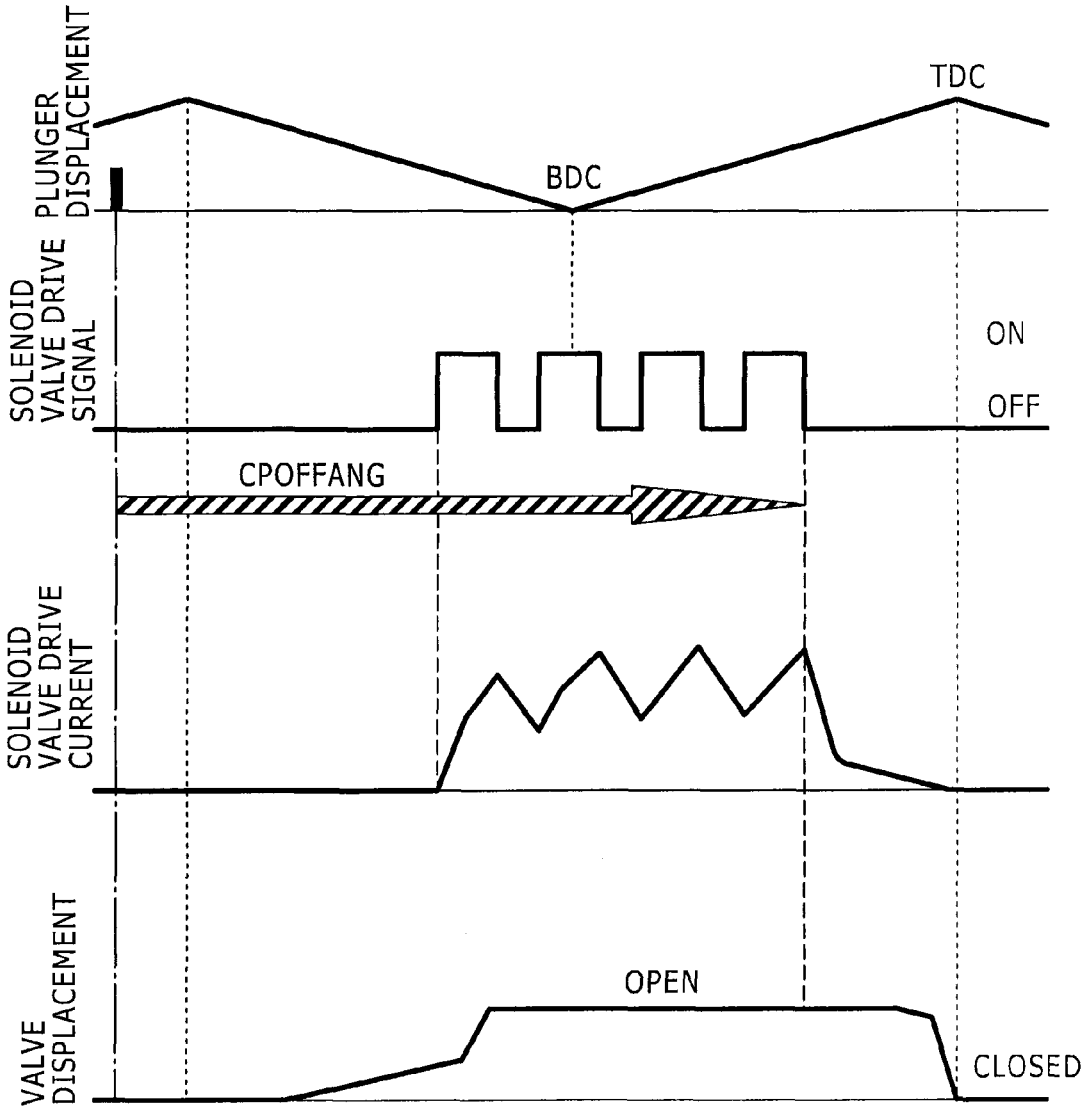
FIG. 13 is a diagram showing how a compulsory output off angle is set for the high pressure fuel pump.

FIG. 13 shows how the compulsory output off angle CPOFFANG is set. The CPOFFANG is aimed at stopping power distribution for an angle range where the pump discharges no fuel even when no power is distributed and thereby reducing power consumption and preventing heat generation by the solenoid 200. As shown in FIG. 13, even when the drive signal is discontinued before the T.D.C. is reached, the valve is left open, without being immediately closed, until the T.D.C. is almost reached. The pump then enters a state of no-discharge operation.

Figure 14:
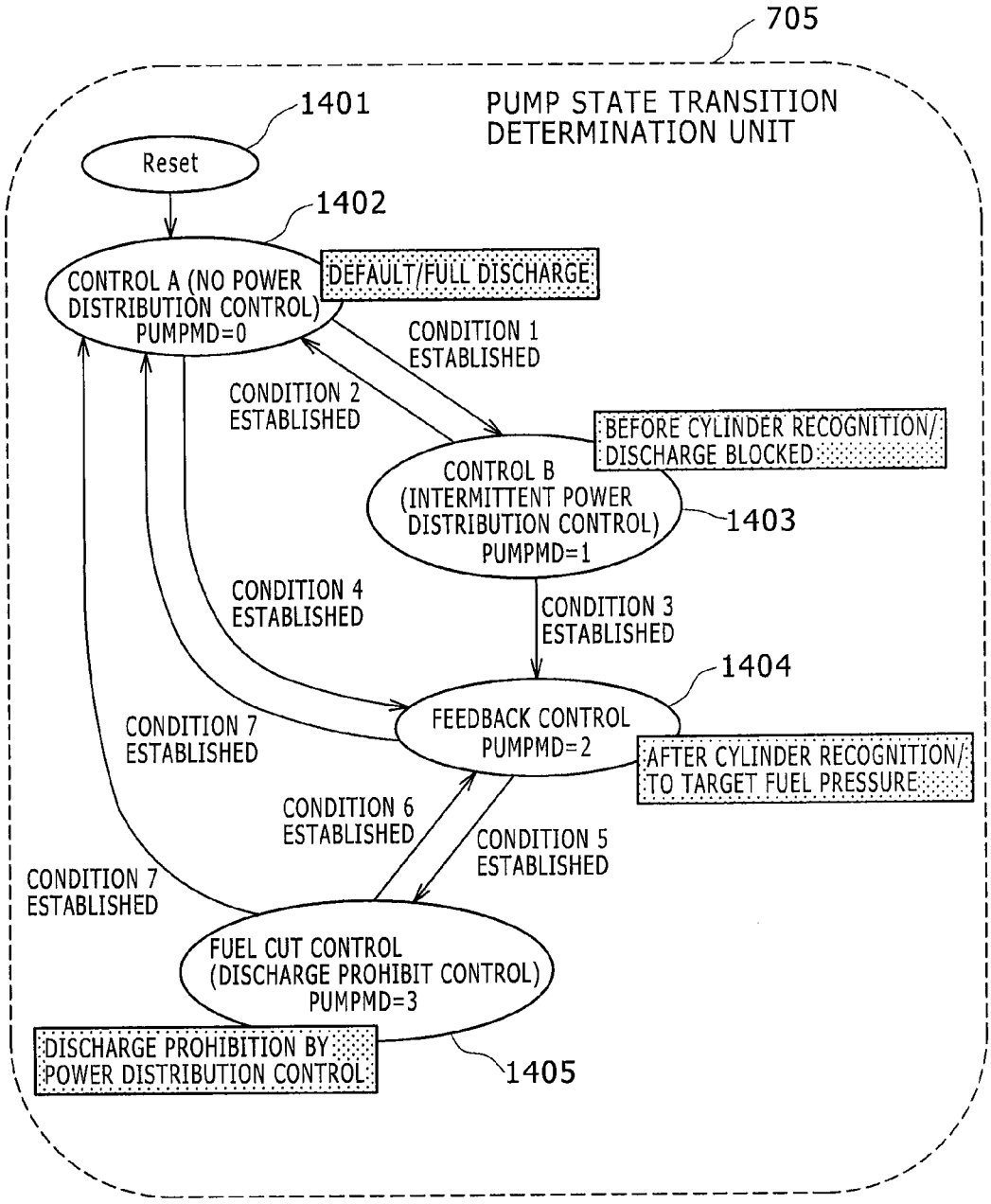
FIG. 14 is a control state transition diagram according to the present invention of the engine control unit shown in FIG. 1.

FIG. 14 is a state transition diagram showing an aspect of the pump state transition determination unit 705. The pump state transition determination unit 705 has four control blocks, i.e. a control A block 1402, a control B block 1403, a feedback control block 1404, and a fuel cut control block 1405.

The control A block 1402 is for default control. The control B block 1403 is for preventing, in cases where the residual pressure in the common rail is high, a pressure rise before a REF signal is recognized. The feedback control block 1404 is for controlling the fuel pressure to a target value. The fuel cut control block 1405 is for stopping pressure-feeding of the fuel so as to prevent, while the fuel supply is stopped, the fuel pressure in the common rail from rising.

When the ignition switch is turned on and the MPU 603 of the control unit 515 is reset, a control state with no power distribution, i.e. the control state of the control A block 1402, is entered. In this state, pump state variable PUMPMD is set to 0 (PUMPMD=0) and no power is distributed to the solenoid 200.

When the starter switch is subsequently turned on causing the engine 507 to be cranked and a crank angle signal CRANK to be detected whereas the fuel pressure in the common rail 53 is high, condition 1 is established and control shifts to the control B block 1403 entering an equal-interval power distribution control state. In this state, pump state variable PUMPMD is set to 1 (PUMPMD=1). At this time, in the control B block 1403, even though pulses of the crank angle signal CRANK have been detected, stroking of the plunger 2 to generate a REF signal has not been recognized, so that the plunger phase between the crank angle signal CRANK and the cam angle signal CAM has not been determined. Namely, in this state, the time when the plunger 2 of the high pressure fuel pump 1 reaches the B.D.C. has not been recognized.

Figure 17:
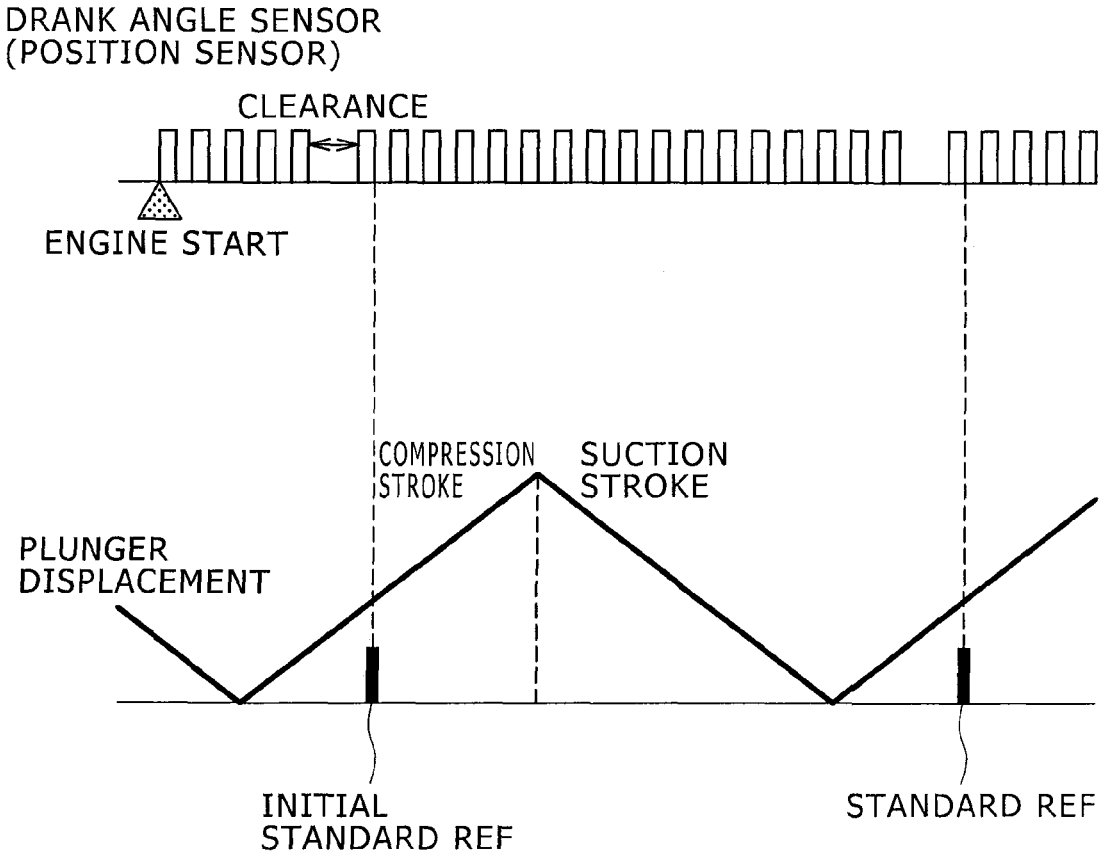
FIG. 17 is a diagram showing how a standard REF is generated for the high pressure fuel pump.
Figure 18:
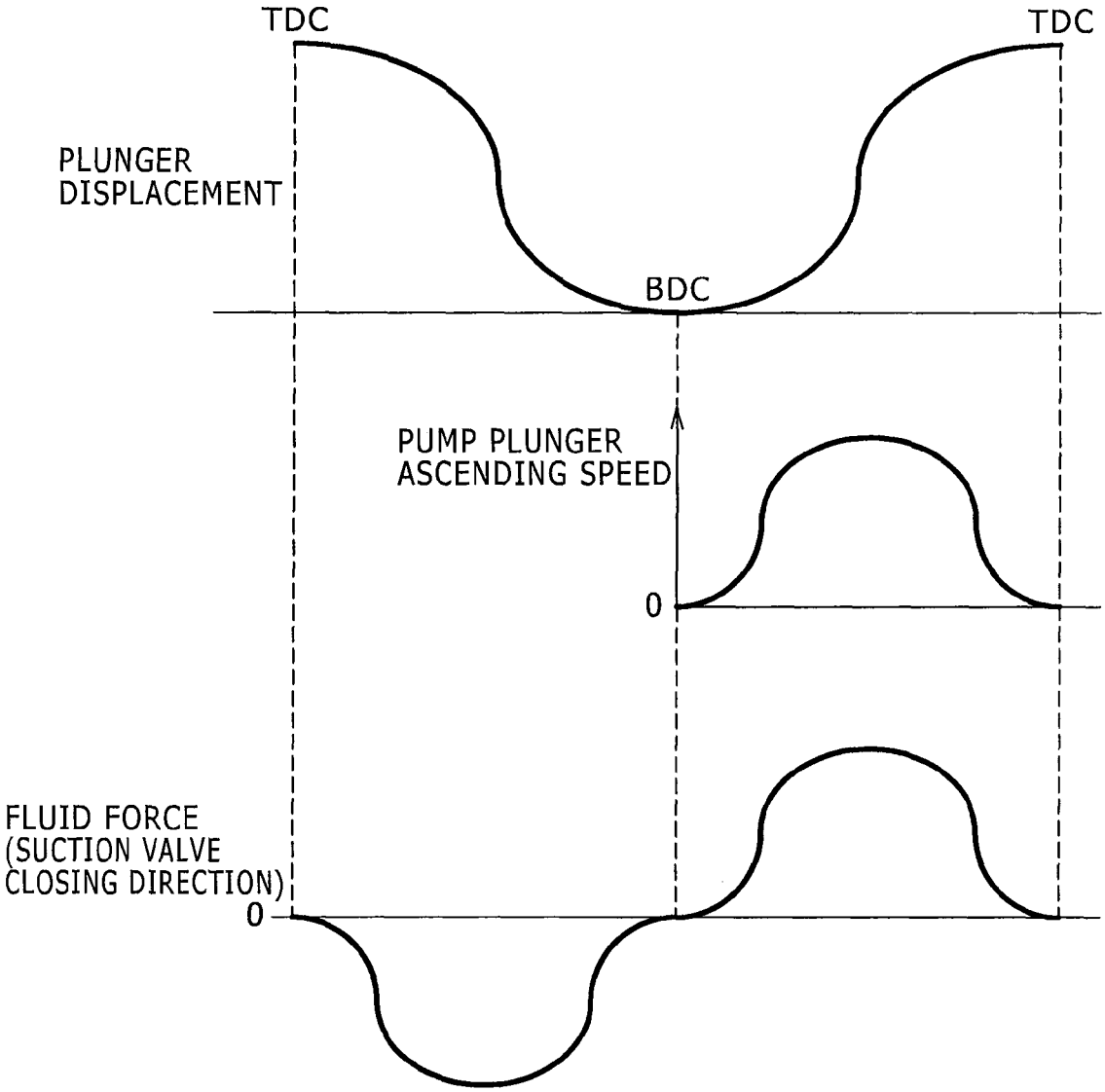
FIG. 18 is a diagram showing a relationship, relative to the pump plunger displacement in a pressurized chamber of the high pressure fuel pump, between the fluid force and the plunger speed.

When cranking of the engine advances from an initial stage to a middle stage and the plunger phase between the crank angle signal CRANK and the cam angle signal CAM is determined, making it possible to generate a phase control reference signal (hereinafter referred to as a "standard REF"), condition 3 is established causing control to shift to the feedback control block 1404 where pump state variable PUMPMD is set to 2 (PUMPMD=2) and a solenoid control signal is outputted so as to control an actual fuel pressure determined by the fuel pressure input processing unit 701 to a target fuel pressure calculated by the target fuel pressure calculation unit 702. FIG. 17 shows an example method of standard REF generation. The crank angle sensor signal, as shown in FIG. 17, has clearance portions. When, after the engine is started, a first clearance portion occurs in the crank angle sensor signal, a standard REF is generated from the crank angle sensor signal value at that instant. Subsequently, a standard REF is generated from the crank angle sensor signal at constant angle intervals. Clearance portions are recognized based on crank sensor input intervals.

In cases where the plunger phase is not determined and a REF signal cannot be generated, condition 2 is established and control shifts to the control A block. When, after the starter switch is turned on and the engine 507 starts being cranked, the fuel pressure in the common rail 53 is low, the control A block keeps control to promote rising of the fuel pressure until the plunger phase between the crank angle signal CRANK and the cam angle signal CAM is determined making it possible to generate a REF signal. When, subsequently, condition 4 is established, control shifts to the feedback control block 1404.

Subsequently, control remains with the feedback control block 1404 unless the engine fails or condition 5 is established. When, with control remaining with the feedback control block 1404, the fuel supply is cut, for example, due to a slow-down of the vehicle, the injector 54 injects no fuel. When this occurs, the fuel in the common rail 53 does not decrease, so that condition 5 is established. Control then shifts to the fuel cut control block 1405; pump state variable PUMPMD is set to 3 (PUMPMD=3); and feeding of the fuel from the high pressure fuel pump 1 to the common rail 53 is stopped. When, while control remains with the fuel cut control block 1405, feeding of the fuel is resumed causing condition 6 to be established, control shifts to the feedback control block 1404 and normal feedback control is resumed.

If the engine fails while control remains with the feedback control block 1404 or fuel cut control block 1405, condition 7 is established and control shifts to the control A block 1402.

Figure 15:
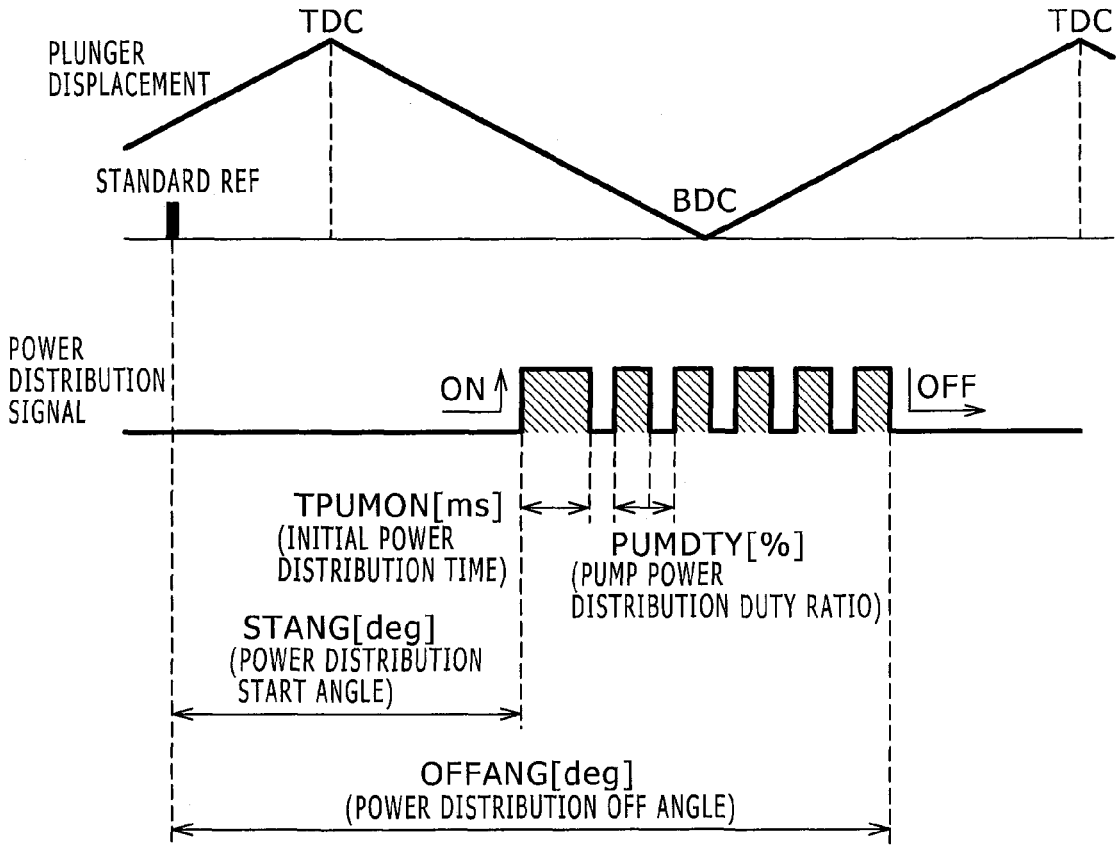
FIG. 15 is a control timing chart according to the present invention of the engine control unit shown in FIG. 1.

FIG. 15 is a timing chart of a power distribution signal given to the solenoid 200 during feedback control. An open current control duty is outputted during a period from the power distribution start angle STANG to the power distribution off angle OFFANG. The open current control duty includes an initial power distribution time TPUMON and a duty ratio PUMDTY following the initial power distribution. The initial power distribution time TPUMON and the duty ratio PUMDTY following the initial power distribution are calculated in the pump control duty calculation unit 704.

Figure 16:
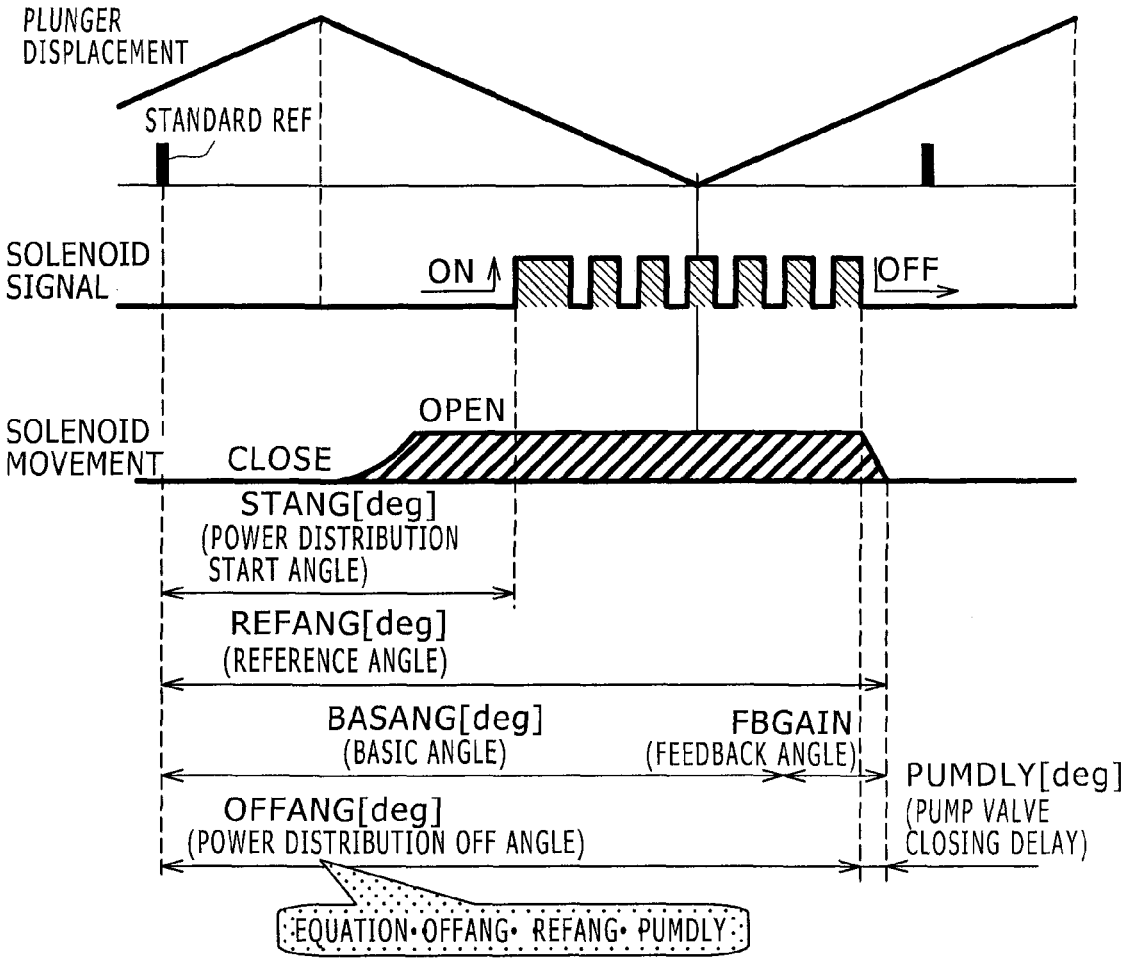
FIG. 16 is a control timing chart according to the present invention of the engine control unit shown in FIG. 1.

FIG. 16 shows parameters used for the power distribution start angle STANG and the power distribution off angle OFFANG of a solenoid control signal used for fuel pressure control by the control unit 515.

The power distribution start angle STANG and the power distribution off angle OFFANG of the solenoid control signal are set from a standard REF generated based on the CRANK signal and the CAM signal and the stroke of the plunger 2. First, the power distribution start angle STANG is calculated using a map as shown in FIG. 9.

The power distribution off angle OFFANG can be calculated using the following equation (1).

$$OFFANG=REFANG-PUMDLY \quad \text{(Equation 1)}$$

where REFANG is a reference angle which can be calculated using the following equation (2).

$$REFANG=BASANG+FBGAIN \quad \text{(Equation 2)}$$

where: BASANG is a basic angle which is calculated using a basic angle map 1101 (FIG. 11) based on the operating condition of the engine 507; PUMDLY is a pump delay angle; and FBGAIN is a feedback gain.

Figure 21:
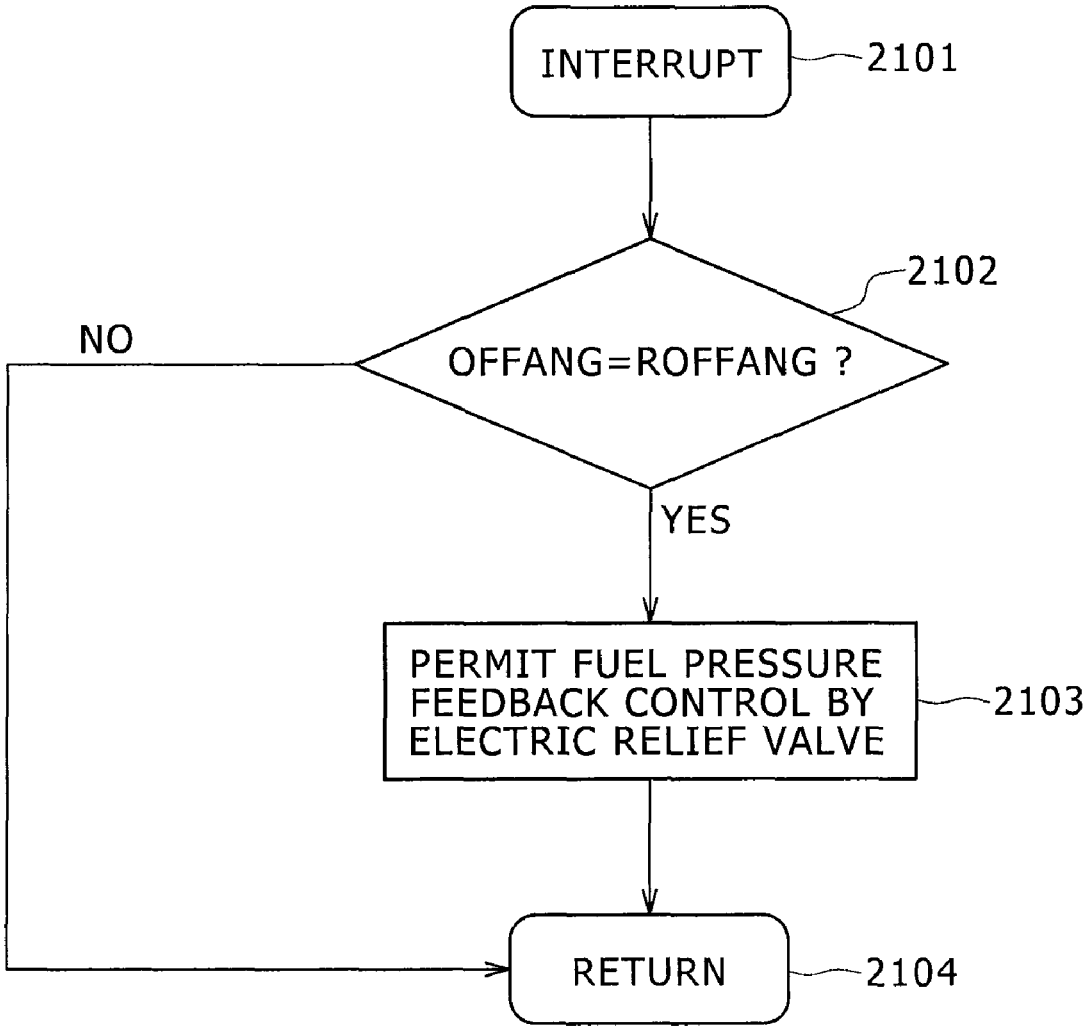
FIG. 21 is a control flowchart according to the present invention of the engine control unit shown in FIG. 1.

FIG. 21 is a control flowchart of an embodiment of the present invention. In step 2101, an interrupt is executed, for example, every 10 ms or with a standard REF period. In step 2102, it is determined whether the power distribution off angle OFFANG equals the fluid force off angle ROFFANG. When the power distribution off angle OFFANG equals the fluid force off angle ROFFANG, the discharge quantity of the high pressure fuel pump is fixed, and the fuel pressure is controlled using the electric relief valve 55. Namely, when it is determined in step 2102 that the power distribution off angle OFFANG equals the fluid force off angle ROFFANG, processing advances to step 2103. In step 2103, fuel pressure feedback control by the electric relief valve 55 is permitted. Processing then advances to step 2104 to terminate the routine.

The fuel pressure control using the electric relief valve 55 is not performed except when the power distribution off angle OFFANG equals the fluid force off angle ROFFANG. This contributes toward improving responsiveness to a request for a fuel pressure increase and reducing the power consumption and the operational load on the control unit 515.

Figure 22:
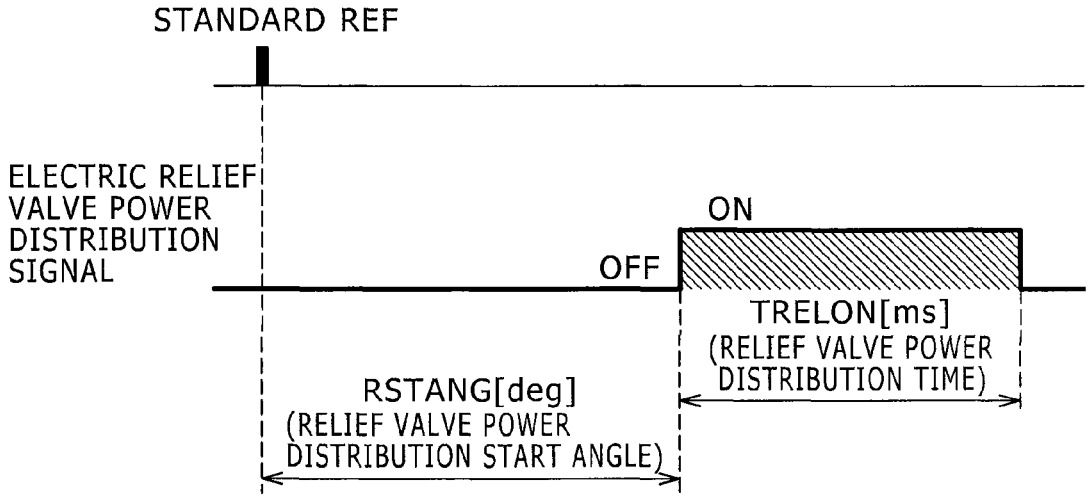
FIG. 22 is a control timing chart according to the present invention of the engine control unit shown in FIG. 1.

FIG. 22 is a timing chart of a relief valve drive signal used in fuel pressure control performed using the electric relief valve 55. As in controlling the high pressure fuel pump, a standard REF is set, and the relief valve is energized when a relief valve power distribution start angle RELSTANG is passed from the standard REF to be kept energized as long as a relief valve power distribution time TRELON. The power distribution off angle OFFANG and the relief valve power distribution start angle RELSTANG are equalized so as to cause the fuel discharge period of the high pressure pump and the relief period of the electric relief valve to overlap each other and reduce the fuel pressure drop when the electric relief valve is open.

Figure 23:
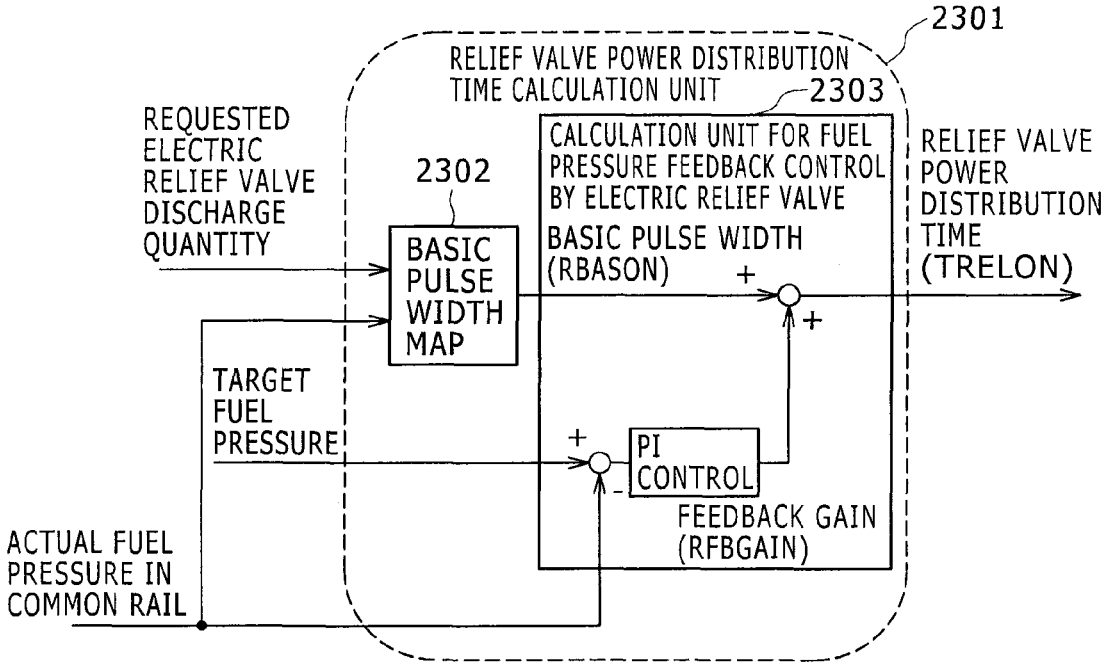
FIG. 23 is a control flowchart according to the present invention of the engine control unit shown in FIG. 1.

FIG. 23 is a control block diagram showing an aspect of control performed by a relief valve power distribution time (TRELON) calculation unit 2301. In block 2302, a basic pulse width RBASON is calculated based on a requested relief valve discharge quantity and the fuel pressure in the common rail. The relief valve discharge quantity is the difference between the injection quantity of the injector and the quantity of fuel discharged by the high pressure fuel pump operated under fixed discharge control. The relief valve power distribution time TRELON is calculated based on a feedback gain RFBGAIN and the basic pulse width RBASON.

The feedback gain RFBGAIN has a function to shorten the relief valve power distribution time when the target fuel pressure is higher than the actual fuel pressure and lengthen the relief valve power distribution time when the target fuel pressure is lower than the actual fuel pressure.

The relief valve is required to be capable of releasing a quantity of fuel corresponding to the difference between the injection quantity of the injector and the quantity of fuel discharged by the high pressure fuel pump operated under fixed discharge control. The minimum flow amount controllable by the relief valve is required not to exceed a minimum fixed discharge quantity of the pump set according to various operating conditions of the pump.

Thus, the above embodiment of the present invention configured as described above provides the following functions.

The control unit 515 of the above embodiment is a high pressure fuel supply control system for the direct injection engine 507 that includes the injectors 54 provided for the cylinders 507*b*, the high pressure fuel pump 1 for feeding fuel to the injectors 54, the common rail 53, and the fuel pressure sensor 56. The control unit 515 can reduce shot-to-shot varieties in the quantity of fuel discharged by the high pressure fuel pump. When such varieties are reduced, the fuel pressure pulsation in the common rail can be reduced making it possible to stabilize operation of the fuel system and fuel combustion and improve emission gas performance.

Figure 24:
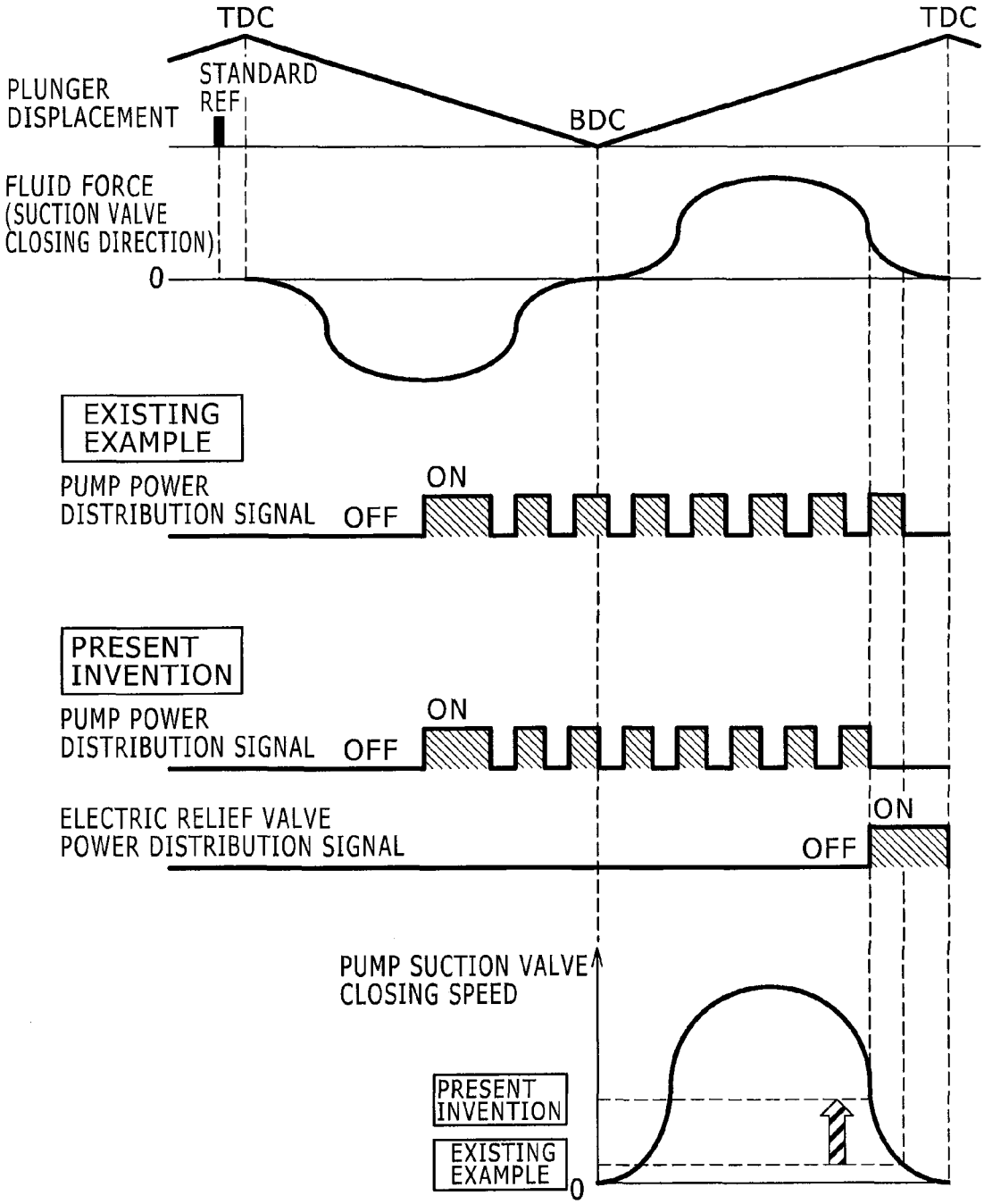
FIG. 24 is a diagram for explaining an effect of the present invention.

An advantageous effect of the present invention will be explained with reference to FIG. 24. FIG. 24 is a timing chart for comparing a fuel supply control system according to the present invention and an existing fuel supply control system both assumed to supply their common rail with a same amount of fuel. In the case of the existing system, the fuel discharge by the pump is controlled when the closing force of the suction valve is relatively small, possibly causing the suction valve closing time to vary largely. In the case of the system according to the present invention, the fuel discharge by the pump is controlled with an adequate fluid force secured, so that the suction valve closing speed is improved making it possible to reduce varieties in the suction valve closing time and thereby reduce the fuel pressure pulsation. This makes it possible to stabilize operation of the fuel system and fuel combustion and improve emission gas performance.

Even though an embodiment of the present invention has been described in detail, the present invention is not limited to the embodiment, but may be modified in various ways in design without departing from the spirit of the invention described in the appended claims. Even though the high pressure fuel pump of the embodiment is provided with a normally closed solenoid valve, a similar advantageous effect can be obtained from the invention using a high pressure fuel pump provided with a normally open solenoid valve.

An advantageous effect similar to that described above of the invention can be obtained also in cases where the fuel discharge quantity of the high pressure fuel pump is kept at or above a certain level using a relief hole formed in a high pressure portion, for example, a common rail without using an electric relief valve.

What is claimed is:

1. A fuel supply control system for an internal combustion engine, the control system controlling a fuel pump which takes fuel on a low pressure side into a pressurized chamber via a fuel passage valve opening and closing according to movement of an actuator, pressurizes the fuel using a plunger, and discharges the fuel into a common rail; wherein:

the fuel pump is controlled, by controlling the actuator, to keep a discharge quantity thereof larger than a first prescribed value; and the first prescribed value is determined such that a fluid force applied to the fuel passage valve in a closing direction thereof is equal to or larger than a second prescribed value.

2. The fuel supply control system for an internal combustion engine according to claim 1, wherein, when a pressure decrease in the common rail is requested, controlling the fuel pump to keep the discharge quantity thereof larger than the first prescribed value is prohibited.

3. The fuel supply control system for an internal combustion engine according to claim 1, wherein the first prescribed value is determined according to an engine speed.

4. The fuel supply control system for an internal combustion engine according to claim 1, wherein at least one of the fuel pump and the common rail is provided with a device for returning fuel from a high pressure side to a low pressure side.

5. The fuel supply control system for an internal combustion engine according to claim 4, wherein the device for returning fuel to the low pressure side is an electric pressure control valve which is opened by an electric drive signal.

6. The fuel supply control system for an internal combustion engine according to claim 5, wherein the electric pressure control valve is open during a discharge stroke of the fuel pump.

7. The fuel supply control system for an internal combustion engine according to claim 5, wherein a minimum flow amount of the electric pressure control valve does not exceed the first prescribed value.

8. The fuel supply control system for an internal combustion engine according to claim 5, wherein, when a pressure increase in the common rail is requested, the electric pressure control valve is closed.

9. The fuel supply control system for an internal combustion engine according to claim 5, wherein, when a discharge quantity equal to or larger than the first prescribed value is requested, the electric pressure control valve is closed.

10. A fuel supply control system for an internal combustion engine, the control system controlling a fuel pump which takes fuel on a low pressure side into a pressurized chamber via a fuel passage valve opening and closing according to movement of an actuator, pressurizes the fuel using a plunger, and discharges the fuel into a common rail; wherein:

the fuel pump is controlled, by controlling the actuator, to keep a discharge quantity thereof larger than a first prescribed value; and the first prescribed value does not exceed one half of a full discharge quantity of the fuel pump.

11. The fuel supply control system for an internal combustion engine according to claim 10, wherein, when a pressure decrease in the common rail is requested, controlling the fuel pump to keep the discharge quantity thereof larger than the first prescribed value is prohibited.

12. The fuel supply control system for an internal combustion engine according to claim 10, wherein the first prescribed value is determined according to an engine speed.

13. The fuel supply control system for an internal combustion engine according to claim 10, wherein at least one of the fuel pump and the common rail is provided with a device for returning fuel from a high pressure side to a low pressure side.

14. The fuel supply control system for an internal combustion engine according to claim 13, wherein the device for returning fuel to the low pressure side is an electric pressure control valve which is opened by an electric drive signal.

15. The fuel supply control system for an internal combustion engine according to claim 14, wherein the electric pressure control valve is open during a discharge stroke of the fuel pump.

16. The fuel supply control system for an internal combustion engine according to claim 14, wherein a minimum flow amount of the electric pressure control valve does not exceed the first prescribed value.

17. The fuel supply control system for an internal combustion engine according to claim 14, wherein, when a pressure increase in the common rail is requested, the electric pressure control valve is closed.

18. The fuel supply control system for an internal combustion engine according to claim 14, wherein, when a discharge quantity equal to or larger than the first prescribed value is requested, the electric pressure control valve is closed.

* * * * *